US012152784B2

(12) United States Patent
Koenneker et al.

(10) Patent No.: US 12,152,784 B2
(45) Date of Patent: Nov. 26, 2024

(54) HOB SYSTEM

(71) Applicant: Wilhelm Bruckbauer, Niederndorf (AT)

(72) Inventors: Walter Koenneker, Niederndorf (AT); Matthias Karl, Niederndorf (AT); Wilhelm Bruckbauer, Niederndorf (AT); Siegfried Goessler, Niederndorf (AT); Anton Schmoeller, Niederndorf (AT)

(73) Assignee: WERKHAUS GMBH & CO. KG (DE)

( * ) Notice: Subject to any disclaimer, the term of this patent is extended or adjusted under 35 U.S.C. 154(b) by 584 days.

(21) Appl. No.: 17/430,659

(22) PCT Filed: Jan. 16, 2020

(86) PCT No.: PCT/EP2020/051057
§ 371 (c)(1),
(2) Date: Aug. 12, 2021

(87) PCT Pub. No.: WO2020/164849
PCT Pub. Date: Aug. 20, 2020

(65) Prior Publication Data

US 2022/0146114 A1 May 12, 2022

(30) Foreign Application Priority Data

Feb. 15, 2019 (DE) ..... 10 2019 202 088.7

(51) Int. Cl.
*F24C 15/10* (2006.01)
*F24C 15/20* (2006.01)

(52) U.S. Cl.
CPC ..... *F24C 15/10* (2013.01); *F24C 15/2042* (2013.01)

(58) Field of Classification Search
CPC .. F24C 15/2042; F24C 15/20; F24C 15/2035; A47J 36/38
See application file for complete search history.

(56) References Cited

U.S. PATENT DOCUMENTS

2007/0062513 A1 3/2007 Gagas
2010/0163549 A1* 7/2010 Gagas ..... F24C 15/2042 219/622
2011/0290782 A1* 12/2011 Donarski ..... H05B 1/0202 219/443.1
2014/0034040 A1 2/2014 Sinur et al.
2014/0048057 A1* 2/2014 Bruckbauer ..... F24C 15/2035 126/299 D
2017/0138606 A1* 5/2017 Martinez Diez ..... F24C 3/082
2017/0261211 A1* 9/2017 Paitchell ..... F24C 15/107
(Continued)

FOREIGN PATENT DOCUMENTS

DE 102007002241 A1 7/2008
DE 102010003700 A1 10/2011
(Continued)

*Primary Examiner* — Vivek K Shirsat
(74) *Attorney, Agent, or Firm* — POLSINELLI PC

(57) ABSTRACT

A hob system comprising a cooking goods carrier for carrying cooking goods, at least one heating unit arranged on the cooking goods carrier for heating the cooking goods, and a fume extractor device for extracting cooking vapors downward, wherein a total width of the hob system is a maximum of 600 mm.

14 Claims, 14 Drawing Sheets

(56) References Cited

U.S. PATENT DOCUMENTS

| | | | | |
|---|---|---|---|---|
| 2018/0283699 | A1* | 10/2018 | Armstrong | F24C 15/2092 |
| 2019/0212016 | A1* | 7/2019 | Könneker | F24C 15/2042 |

FOREIGN PATENT DOCUMENTS

| | | | | |
|---|---|---|---|---|
| DE | 102010042436 | A1 | 4/2012 | |
| DE | 102016211207 | A1 | 12/2017 | |
| EP | 3267116 | A1 * | 1/2018 | F24C 15/101 |
| EP | 3453974 | A1 | 3/2019 | |
| EP | 3564588 | A1 | 11/2019 | |
| EP | 3572673 | A1 | 11/2019 | |
| GB | 1130803 | | 10/1968 | |
| WO | WO-2012146237 | A1 | 11/2012 | |
| WO | WO-2013166445 | A1 | 11/2013 | |
| WO | WO-2017029128 | A1 | 2/2017 | |

* cited by examiner

HOB SYSTEM

CROSS-REFERENCES TO RELATED APPLICATIONS

The present patent application claims the priority of German Patent Application, Serial No. 10 2019 202 088.7, filed Feb. 15, 2019, pursuant to 35 U.S.C. 119(a)-(d), the contents of which are incorporated herein by reference.

FIELD OF THE INVENTION

The invention relates to a hob system. Further, the invention relates to a kitchen workplace with such a hob system.

BACKGROUND OF THE INVENTION

A fume extractor device for extracting cooking vapors downward is known from WO 2012/146237 A1. The hob system has an inflow opening through which the cooking vapors are extracted. This inflow opening is arranged in a central region of the hob system, for an efficient extraction of the cooking vapors. It is disadvantageous that such an arrangement of the inflow opening leads to an increased installation space requirement in the horizontal direction.

SUMMARY OF THE INVENTION

It is an object of the invention to improve a hob system.

This object is achieved by means of a hob system comprising a cooking goods carrier for carrying cooking goods, at least one heating unit arranged at the cooking goods carrier for heating the cooking goods, and a fume extractor device for extracting cooking vapors downward, with at least one fan for extracting the cooking vapors, at least one inflow opening which penetrates the cooking goods carrier, and a negative pressure duct, which links the at least one inflow opening to the at least one fan in a fluid-conducting manner, wherein a total width of the hob system is a maximum of 600 mm, and wherein the at least one inflow opening is spaced apart from an edge region of the cooking goods carrier. According to the invention, it has been found that the hob system with a cooking goods carrier, at least one heating unit and a fume extractor device for extracting cooking vapors downward must have a total width of a maximum of 600 mm in order to be able to be implemented and installed in a particularly flexible manner. A hob system of this type enables particularly intensive use of the space available in a kitchen. Especially in urban areas with increasingly small residential units, a hob system of this type may contribute to intensive and comfortable use of living space, in particular by reducing the amount of working surface required. It is particularly advantageous that such a hob system can be inserted into a kitchen base cabinet with a maximum storage space width of 600 mm, which significantly increases the design freedom in kitchen planning.

According to one aspect of the invention, the hob system has at least two heating units, in particular at least three heating units, in particular at least four heating units. The at least one heating unit may be configured as a radiation heating unit and/or as an induction heating unit and/or as a mass heating unit and/or as a tepan heating unit. In particular, the at least one heating unit may be designed as to be operated with electrical energy and/or with fuel gas.

According to one aspect of the invention, a total width of the hob system with the cooking goods carrier, with all of the heating units and with the fume extractor device, in particular with a fan and/or a negative pressure duct, is a maximum of 600 mm, in particular a maximum of 580 mm, in particular a maximum of 560 mm, in particular a maximum of 500 mm, in particular a maximum of 450 mm, in particular a maximum of 400 mm, in particular a maximum of 350 mm, in particular a maximum of 300 mm. A total depth of the hob system with the cooking goods carrier, all of the heating units and the fume extractor device, in particular with the fan and/or the negative pressure duct, is preferably a maximum of 600 mm, in particular a maximum of 550 mm, in particular a maximum of 515 mm, in particular a maximum of 500 mm, in particular a maximum of 450 mm. According to a particularly preferred embodiment, the total width is a maximum of 560 mm and the total depth is a maximum of 515 mm. The total width of the hob system is to be understood as the extension of the hob system in parallel to a front edge of the hob system facing a user, in particular of the cooking goods carrier, in particular in a horizontal plane. The total depth is to be understood as an extension of the bob system perpendicular to a front edge of the hob system facing the user, in particular of the cooking goods carrier, in particular in a horizontal plane.

In accordance with one aspect of the invention, a ratio between the total depth and the total width is at least 0.8, in particular at least 0.9, in particular at least 1, in particular at least 1.2, in particular at least 1.5, in particular at least 1.8.

According to another aspect of the invention, the fume extractor device has an inflow opening through which the cooking vapors are extracted. The inflow opening may, for example, be directly adjacent to an edge region of the cooking goods carrier or spaced apart therefrom.

In a top view, the inflow opening can be round, in particular non-circular or circular and/or oval or in the shape of a polygon, in particular in the shape of a triangle or in the shape of a quadrilateral or in the shape of a pentagon or in the shape of a hexagon.

According to one aspect of the invention, the hob system comprises power electronics for supplying electrical power to the at least one heating unit. The power electronics preferably comprise at least one, in particular at least 2, in particular at least 3 power electronics circuit boards. A separate, independent power electronics circuit board may be provided for each of the heating units. Preferably, at least one power electronics circuit board is designed to supply two of the heating units with electrical power. All of the power electronics circuit boards can also be designed to supply two or more heating units. The heating units are preferably induction heating units. The power electronics may correspondingly comprise induction generators. Advantageously, as a result of the arrangement of the power electronics on separate power electronics circuit boards, these can be arranged in an especially compact manner, in particular in an especially flexible manner with respect to the further components of the hob system.

According to another aspect of the invention, at least one of the power electronics circuit boards is oriented vertically and/or at least one of the power electronics circuit boards is oriented horizontally. At least one of the power electronics circuit boards may also be oriented obliquely to a vertical direction and to a horizontal plane. Advantageously, as a result, the power electronics circuit boards can be arranged in an especially flexible manner, thus saving installation space.

Preferably, at least one cooling fan is provided for cooling the power electronics. Preferably, at least one cooling fan is arranged on each of at least two of the power electronics circuit boards. The cooling of the power electronics can thus be performed particularly effectively and efficiently.

According to one aspect of the invention, at least two power electronics circuit boards are provided which are interconnected in a signal-transmitting and/or power-transmitting manner. The connection can be provided by means of a flexible cable connection and/or by means of rigid conductor rails.

Preferably, a cooling element is provided on the power electronics, in particular on at least 2, in particular on all, power electronics circuit boards. This enables effective cooling of a plurality of the power electronics circuit boards by means of only a smaller number of cooling fans, in particular only one cooling fan.

Preferably, the power electronics are designed to supply the at least one heating unit and the fume extractor device, in particular the at least one fan, with electrical power. For example, a fan control of the fume extractor device can be integrated into the power electronics. In particular, the power electronics for supplying the fume extractor device with electrical power may be arranged on the same power electronics circuit board as the power electronics for the at least one heating unit. Such a design is particularly installation space-saving and can be realized economically. Preferably, at least one interface is provided on the at least one power electronics circuit board, for connecting external elements, such as a window tilt sensor and/or a user interface.

In a top view, the at least one power electronics circuit board is preferably arranged in an edge region of the hob system. The at least one power electronics circuit board is preferably arranged at a distance of a maximum of 50 mm, in particular a maximum of 20 mm, from an outer edge of the hob system. A central region of the hob system is thus available for extracting the cooking vapors downward. For example, the at least one power electronics circuit board may be disposed in a front edge region and/or in a rear edge region and/or in a lateral edge region of the hob system.

In accordance with another aspect of the invention, at least two power electronics housings are provided for receiving at least one of the power electronics circuit boards in each case.

According to another aspect of the invention, at least one partition wall is provided between two of the power electronics circuit boards. The partition wall may be a component of the at least one power electronics housing. The partition wall may be configured to shield the respective power electronics circuit boards from magnetic fields and/or electromagnetic radiation and/or moisture.

According to a further aspect of the invention, the power electronics housing is formed in one piece, in particular integrally, in particular in a material-locking manner, with a cooking vapor duct, in particular a negative pressure duct and/or a positive pressure duct, of the fume extractor device. The power electronics housing can be connected with the cooking vapor duct in a thermally conductive manner, in particular in a gas-tight manner with respect to the cooking vapor duct, and/or in a flow-conductive manner. Advantageously, as a result, the cooking vapor flow can be used to cool the power electronics. For example, a control device for controlling the electronics fans can be designed such that the electronics fans are controlled depending on the cooking fume extraction. The hob system can thus be operated in a particularly energy-efficient manner.

According to a further aspect of the invention, a dimension, in particular in the main extension direction, and/or a diameter of a cooking zone heatable by means of the at least one heating unit is in a range of 50 mm to 300 mm, in particular of 60 mm to 250 mm, in particular of 75 mm to 220 mm. Preferably, the diameter of induction coils of the respective heating unit is in a range of 50 mm to 300 mm, in particular of 60 mm to 250 mm, in particular of 75 mm to 220 mm. Preferably, the main extension of at least one cooking zone and/or the diameter of at least one induction coil is in a range of 50 mm to 120 mm, in particular of 60 mm to 100 mm, in particular of 70 mm to 90 mm. Preferably, such an induction coil is designed to transmit a maximum heating power of at least 300 W, in particular at least 400 W, in particular at least 500 W, in particular at least 600 W. Correspondingly small and powerful heating units enable a particularly compact design of the hob system, in particular with a total width of a maximum of 600 mm.

The invention further relates to a combined appliance comprising a hob system as described above and an oven, in particular a baking oven. Preferably, the combined appliance is provided as an assembly unit. The fume extractor device can be in fluid-conducting communication with an oven interior space and/or a housing space surrounding the oven interior space. Preferably, the fume extractor device is in air-conducting communication with the oven interior space for generating a circulating air flow and/or for extracting cooking vapors, in particular moisture. The fume extractor device may be in air-conducting communication with the housing space for providing a cooling air flow. The combined appliance can be realized in a particularly compact and economical manner. In particular, the combined appliance can be easily and economically integrated into a kitchen base cabinet. For this purpose, the kitchen base cabinet may be designed with or without a rear wall.

A main dimension, in particular a diameter, of the inflow opening is preferably at least 100 mm, in particular at least 140 mm, in particular at least 160 mm, in particular at least 170 mm. A main dimension, in particular a diameter, of the inflow opening is preferably a maximum of 250 mm, in particular a maximum of 220 mm, in particular a maximum of 200 mm, in particular a maximum of 180 mm. As a result, a particularly efficient extraction of cooking vapors can be achieved along with a very compact design of the hob system.

According to another aspect of the invention, the fume extractor device comprises at least one grease filter and/or at least one odor filter. The at least one odor filter may be disposed in a positive pressure duct, in particular downstream of the at least one fan. Preferably, the at least one odor filter can be removed reversibly from the fume extractor device through its inflow opening. For this purpose, the fume extractor device may have a filter exchange space which links the positive pressure duct with the negative pressure duct. The filter exchange space can preferably be reversibly closed. A circulation of cooking vapors through the filter exchange space during operation of the fume extractor device can thus be reliably prevented. For closing the filter exchange space, preferably a suction space closure for reversibly closing the negative pressure duct and/or a pressure space closure for reversibly closing the positive pressure duct are provided. The suction space closure and the pressure space closure can be connected to each other in one piece.

According to a further aspect of the invention, the maximum power output of the at least one heating unit, in particular the at least one induction coil, is in a range of 300 to 4000 watts. Preferably, a ratio of maximum powers of at least two of the heating units, in particular the induction units, is at least 150%, in particular at least 200%, in particular at least 300%, in particular at least 500%, in particular at least 750%. A ratio of main dimensions, in particular diameters, of at least two of the cooking zones is preferably at least 150%, in particular at least 200%, in particular at least 300%.

The hob system may in particular have at least one cooking zone with a diameter of at most 100 mm, in particular at most 90 mm, in particular at most 80 mm, in particular at most 70 mm, in particular at most 60 mm. It may further have at least one cooking zone with a diameter of at least 160 mm, in particular at least 180 mm, in particular at least 200 mm, in particular at least 220 mm, in particular at least 240 mm. On the one hand, the provision of a particularly large cooking zone and a particularly small cooking zone improves flexibility with respect to the use of the hob system. On the other hand, this enables especially good utilization of the available installation space.

The smallest one of the cooking zones may in particular have a maximum power in the range of 300 W to 800 W, in particular in the range of 400 W to 600 W. The largest one of the cooking zones may in particular have a maximum power in the range of 2000 W to 5000 W, in particular in the range of 2500 to 4000 W.

According to a further aspect of the invention, an areal density of the maximum power of the at least one induction coil is in a range of 0.05 W/mm$^2$ to 0.15 W/mm$^2$, in particular of 0.06 W/mm$^2$ to 0.13 W/mm$^2$, in particular of 0.07 W/mm$^2$ to 0.12 W/mm$^2$. Preferably, the areal density of the maximum power of at least one of the induction coils is at least 0.1 W/mm$^2$, in particular at least 0.12 W/mm$^2$, in particular at least 0.14 W/mm$^2$, in particular at least 0.15 W/mm$^2$, in particular at least 0.2 W/mm$^2$. Preferably, a ratio of the areal density of the maximum power of two induction coils of the hob system is at least 120%, in particular at least 130%, in particular at least 150%, in particular at least 200%. According to a further aspect of the invention, at least different induction coils are provided, wherein the induction coil which is larger with respect to its main dimension has an areal density of a maximum power which is lower by at least 10%, in particular by at least 20%, in particular by at least 50%, than the areal density of the maximum power of the smaller induction coil.

According to another aspect of the invention, in a top view, a geometric center of area of the inflow opening is spaced apart from a geometric center of area of the cooking goods carrier. With respect to the depth and/or the width of the hob system, the geometric center of area of the inflow opening may be arranged centrally in the cooking goods carrier. Particularly preferably, the geometric center of area of the inflow opening is arranged off-center with respect to the width of the cooking goods carrier and is arranged in the center of the cooking goods carrier with respect to the depth of the cooking goods carrier, or vice versa. An especially space-saving and at the same time convenient arrangement of the inflow opening and the cooking zones is thus made possible.

The invention further relates to the aspect, which is fundamentally independent but can be combined with the aforementioned features of the hob system, according to which the hob system is designed as to be installed in different orientations, in particular in a kitchen base cabinet and/or in a kitchen workplace. In particular, the hob system may be configured to be installed in either a first orientation or a second orientation, wherein the hob system is rotated by 90° or by 180° about a vertical axis in the second orientation relative to the first orientation. A user interface of the hob system is preferably arranged on the cooking goods carrier, in particular attached thereto. The user interface can be designed to be rotationally symmetrical and/or can be arranged in different orientations on the cooking goods carrier and/or can be arranged on the cooking goods carrier so that it can be reversibly pivoted and/or can comprise a screen which is designed to display control information in a reversibly pivoted manner. The hob system can thus be flexibly adapted to different installation situations.

According to a further aspect of the invention, the hob system comprises a mounting frame. The mounting frame is preferably designed for height-adjustable attachment of the hob system to a kitchen workplace and/or to a kitchen base cabinet. As a result, the mounting of the hob system is considerably facilitated.

According to a further aspect of the invention, the fume extractor device is disposed entirely below the cooking goods carrier.

According to yet another aspect of the invention, a total vertical installation height of the hob system, in particular including the cooking goods carrier, all of the heating units and the fume extractor device, in particular including the fan and/or the negative pressure duct, is a maximum of 300 mm, in particular a maximum of 280 mm, in particular a maximum of 250 mm, in particular a maximum of 220 mm, particularly preferably a maximum of 200 mm, in particular a maximum of 180 mm, in particular 160 mm, in particular 150 mm, in particular 120 mm, in particular 100 mm. In principle, the total installation height may also be greater.

According to a further aspect of the invention, the fume extractor device has at least one, in particular at least two, in particular at least three of the fans for extracting the cooking vapors. Preferably, the hob system with the cooking goods carrier, with all of the heating units and with the fume extractor device, in particular with the fan and/or with the negative pressure duct, is designed as a combined appliance. As a result, the hob system can be mounted in one piece, for example on a workplace. This can significantly reduce the assembly effort.

In accordance with a further aspect of the invention, the hob system comprises exactly three of the heating units. Due to the fact that the hob system has only three of the heating units, the hob system can be designed with a particularly small total width. At the same time, the hob system with the three heating units provides sufficient flexibility in terms of simultaneous heating of different cooking items.

According to another aspect of the invention, the at least one inflow opening penetrates the cooking goods carrier. Advantageously, as a result, the inflow opening can be positioned particularly closely to the heating units. Cooking vapors can thus be extracted directly at the point of origin. The fume extractor device can thus be operated in a particularly energy-efficient manner. The fume extractor device can also have two or three or four of the inflow openings.

According to yet another aspect of the invention, the at least one inflow opening is adjoined by an inflow duct having an initial portion immediately adjacent to the inflow opening. The initial portion may have a central longitudinal axis which is configured to be inclined with respect to a hob normal. The hob normal is understood to be a direction perpendicular to a working surface of the hob, in particular of the cooking goods carrier. An angle between the central longitudinal axis and the hob normal is preferably in a range of 10° to 180°, in particular of 30° to 60°, in particular of 40° to 50°, in particular it is exactly 45°.

In accordance with a further aspect of the invention, the fume extractor device has an inflow grille which can be arranged at the at least one inflow opening. The inlet grille may have at least one guiding element, oriented in particular in the direction of the at least one heating element, for the directed extraction of the cooking vapors. The guiding element can be designed as a guiding sheet, in particular as a lamellar sheet. Preferably, the at least one guiding element does not project upwardly beyond the cooking goods carrier. Alternatively, the guiding element may project beyond the cooking goods carrier. Preferably, the inflow grille at least partially encloses the inflow opening above the cooking goods carrier. The at least one guiding element may shade a region of the inflow opening facing away from the at least one heating unit. For this purpose, the inflow grille preferably has a wall which shades the inflow opening in the horizontal direction and/or upwards at least in portions. Preferably, the inflow grille can be reversibly arranged on the inflow opening.

According to another aspect of the invention, the inflow grille does not completely cover the inflow opening. For example, the inflow opening may be oval in a top view and the inflow grille may be round in a top view. In this case, the inflow opening can completely enclose the inflow grille in a top view. As a result, the cooking vapors extracted through the inflow opening are not completely, but only proportionally, conducted through the inflow grille.

According to yet another aspect of the invention, in a top view, a geometric center of area of the at least one inflow opening is arranged at a distance from a geometric center of area of the cooking goods carrier. Advantageously, as a result, the hob system may be designed to be especially compact, in particular in the horizontal direction.

In accordance with a further aspect of the invention, in the top view, the at least one inflow opening is arranged at a distance from the geometric center of area of the cooking goods carrier, in the width direction and/or in the depth direction. Due to the fact that the at least one inflow opening does not overlap the geometric center of area of the cooking goods carrier, a particularly compact design of the hob system can be ensured.

According to another aspect of the invention, the hob system has a plurality of the heating units, wherein, in the top view, a smallest distance between the geometric center of area of the cooking goods carrier and a first one of the heating units is at least twice as large as a smallest distance between the geometric center of area of the cooking goods carrier and a second one of the heating units. As a result, the hob system can be designed to be especially compact in the horizontal direction. This applies in particular to the use of heating units of different sizes.

According to yet another aspect of the invention, in a top view, at least one of the heating units is formed in a non-circular shape, in particular in a quadrangular shape, in particular in a square or rectangular shape, or in a triangular or hexagonal shape, in particular in the shape of a regular hexagon. Preferably, the at least one heating unit and the inflow opening are each formed in the shape of a regular hexagon. This enables a particularly compact design. Furthermore, the available area below the cooking goods carrier can be used particularly intensively. A minimum distance between all of the heating units is preferably a maximum of 40 mm, in particular a maximum of 20 mm, in particular a maximum of 10 mm.

In accordance with a further aspect of the invention, the distances between the at least one inflow opening and the respective heating unit differ by a maximum of 50%, in particular a maximum of 30%, in particular a maximum of 10%. Preferably, in a top view, all of the heating units are arranged at the same distance from the at least one inflow opening. As a result, an equally efficient extraction of the cooking vapors above each of the heating units can be reliably ensured.

According to another aspect of the invention, in a top view, a smallest distance between the at least one inflow opening and the at least one heating unit is a maximum of 50 mm, in particular a maximum of 30 mm, in particular a maximum of 10 mm. The extraction of the cooking vapors can thus be carried out in a particularly energy-efficient manner.

According to yet another aspect of the invention, in a top view, the at least one heating unit overlaps the geometric center of area of the cooking goods carrier. A particularly compact design of the hob system in the horizontal direction is made possible as a result.

In accordance with a further aspect of the invention, the hob system has a user interface for controlling the at least one heating unit and/or the fume extractor device. In a top view, the user interface may be arranged relative to at least one of the heating units in such a way that it is opposite to the inflow opening. Advantageously, this ensures a particularly compact arrangement of the at least one heating unit, the inflow opening and the user interface in the horizontal direction.

The invention is further based on the object of creating an improved kitchen workplace.

This object is achieved by a kitchen workplace comprising a kitchen base cabinet with a storage space, which has a storage space width of a maximum of 600 mm, and a hob system according to the invention, wherein the heating units and the fume extractor device, in a top view, are arranged completely within the storage space. According to the invention, it has been found that a kitchen workplace must have a kitchen base cabinet with a storage space, which has a storage space width of a maximum of 600 mm, and a hob system according to the above description, wherein the at least one heating unit and the fume extractor device are arranged completely within the storage space in a top view, in order to ensure particularly intensive use of space in a kitchen. The advantages of the kitchen workplace according to the invention correspond to the advantages of the hob system explained above. In particular, the kitchen workplace can be further developed with the features of the hob system.

The storage space may be bounded in the width direction by two vertical partition walls oriented in parallel to one another. Preferably, the partition walls are spaced apart by a maximum of 600 mm. In a top view, the hob system is preferably arranged completely between the two partition walls. Preferably, at least one of the partition walls overlaps the fume extractor device and/or the at least one heating unit in a side view. The partition walls may be designed to support a workplace. The hob system may be fastened to the workplace.

According to a further aspect of the invention, the kitchen base cabinet has a rear wall. The rear wall may have a recess for passage of a cooking vapor duct, in particular a positive pressure duct linked to the hob system.

In accordance with another aspect of the invention, the kitchen base cabinet has fastening means for at least partially fastening the hob system or the positive pressure duct.

According to yet another aspect of the invention, the kitchen base cabinet has a partition wall for bounding a storage space for the hob system downwardly.

The kitchen base cabinet can have heat insulation and/or noise insulation. Advantageously, as a result, a space located below the hob system is reliably protected from heat input and/or noise emission is reduced, in particular during operation of the fume extractor device.

According to an independent aspect of the invention, a fume extractor device for extracting cooking vapors downwardly has at least one inflow opening for the inflow of the cooking vapors and at least one fan for aspirating the cooking vapors at the at least one inflow opening, wherein the fan has a fan wheel rotatably mounted about an axis of rotation and wherein the axis of rotation is oriented in an inclined manner with respect to a horizontal plane and with respect to a vertical direction. Due to the fact that the axis of rotation is oriented so as to be inclined to the horizontal plane and to the vertical direction, the fume extractor device can be integrated into a hob system in a particularly space-saving manner and a flow deflection between the inflow opening and the at least one fan can be reduced, whereby the cooking vapors can be extracted in a particularly energy-efficient manner. The fan is preferably designed as a radial fan. The fan can also be designed as an axial or cross-flow fan.

In accordance with a particularly preferred embodiment of the fume extractor device, a negative pressure duct of an exhaust air duct of the fume extractor device projects downward beyond the at least one fan by a maximum of 50 mm, in particular a maximum of 25 mm, in particular a maximum of 10 mm. Even more preferably, the at least one fan projects downward beyond the negative pressure duct in the vertical direction. A particularly low installation height of the fume extractor device can thus be ensured.

According to a further aspect of the invention, an angle of inclination between the horizontal plane and the axis of rotation of the at least one fan is in a range of 10° to 85°, in particular in a range of 30° to 80°, in particular in a range of 60° to 75°. The angle of inclination can also be exactly 45°.

According to another aspect of the invention, an aspiration direction of the cooking vapors in the at least one fan has an directional component pointing upwards. An angle between the horizontal plane and the aspiration direction is preferably at least 45°, in particular at least 60°, in particular at least 80°. Due to the fact that the aspiration direction has the directional component pointing upwards, the fan can be reliably protected from liquid penetration.

According to yet another aspect of the invention, the negative pressure duct links the at least one inflow opening to the at least one fan in a fluid-conducting manner. A duct centerline of the negative pressure duct preferably along its extension has an absolute angular change of a maximum of 170°, in particular a maximum of 150°, in particular a maximum of 120°, in particular a maximum of 100°. The absolute angular change is preferably at least 100°, in particular at least 120

The absolute angular change is to be understood as the integral of an absolute value of a curvature of the duct centerline along its extension. As a result, the cooking vapors can be extracted in a particularly energy-efficient manner while avoiding turbulent flows, wherein the at least one fan can be reliably protected from penetrating liquids.

In accordance with a further aspect of the invention, the duct centerline is free of inflection points. A conduction of the cooking vapors in the negative pressure duct can thus take place in a particularly laminar manner.

According to one aspect of the invention, the at least one fan overlaps the at least one heating unit in a top view and in a side view and/or in a front view. The heating unit preferably has power electronics for supplying a heating element with electrical power. Preferably, the at least one fan, in particular a fan wheel of the at least one fan, in the top view and in the side view and/or in the front view, overlaps the power electronics and/or a control unit of the hob system and/or a user interface of the hob system. Advantageously, as a result, the hob system, in particular in the vertical direction, can be designed to be particularly compact.

According to an independent aspect of the invention, the fan for aspirating cooking vapors has a fan housing with a negative pressure connection opening and a fan wheel arranged in the fan housing and rotatably mounted about an axis of rotation, wherein the axis of rotation includes a connection angle with a connection normal oriented perpendicularly to the negative pressure connection opening, which connection angle lies in a range of 10° to 85°, in particular in a range of 30° to 80°, in particular in a range of 60° to 75°. Advantageously, as a result, the fan can be connected particularly easily to an initial portion of a negative pressure duct. In particular, a connection area of the initial portion can be oriented substantially vertically or horizontally. Intermediate elements for connecting the initial portion with the negative pressure connection opening can thus be avoided. The fan can thus be used in a particularly cost-effective manner for a fume extractor device for extracting cooking vapors downwardly and/or for a hob system.

Preferably, the fume extractor device has at least three, in particular at least four, in particular at least five, in particular at least six, in particular at least eight, fans. As a result, the fume extractor device can be designed to be particularly compact, i.e. with reduced installation space, and can be operated at a particularly low noise level. The at least three fans can be designed as axial fans and/or radial fans and/or cross-flow fans. A large number of fans allows the use of smaller and/or quieter fans while maintaining the extraction performance. Cross-flow fans have a smaller diameter compared to axial fans while providing the same extraction performance, and therefore enable a particularly compact dimensioning of the fume extractor device.

According to one aspect of the invention, the at least one fan in each case has a fan wheel with a diameter of at most 250 mm, in particular at most 200 mm, particularly preferably at most 180 mm, in particular at most 150 mm, in particular at most 120 mm, in particular at most 100 mm, in particular at most 80 mm, in particular at most 50 mm. The fume extractor device can thus be designed to be particularly compact. The installation space occupied by the fume extractor device is small.

In principle, fans with larger fan wheels, in particular with a diameter of 160 mm, 200 mm or up to 250 mm, can also be used. It is in particular possible to use four fans with fan wheels each having a diameter of 160 mm. The fan wheels can each have an installation height of 80 mm or less, in particular 50 mm or less.

Preferably, an installation height of the fume extractor device is at most 220 mm, in particular at most 200 mm, in particular at most 150 mm, in particular at most 120 mm, in particular at most 100 mm. Advantageously, as a result, the fume extractor device can be designed to be particularly compact. A space below the fume extractor device can be maintained as far as possible as storage space, for example for cooking utensils.

According to another aspect of the invention, the at least one fan is connected to each other via a negative pressure duct of the fume extractor device in an air-conducting manner. The negative pressure duct of the fume extractor device extends between the at least one inflow opening and the at least one fan. Preferably, all of the fans are in air-conducting communication with each other via the negative pressure duct. The at least one fan may be in communication with the at least one inflow opening via a single negative pressure duct. Alternatively, the fume extractor device may have a plurality of inflow openings, each of the inflow openings being in air-conducting communication with one of the fans via a separate negative pressure duct. Preferably, all of the fans can be controlled independently of one another, in particular by means of a corresponding control device. Preferably, cooking fumes can thus be extracted independently of one another via the individual inflow openings. In order to vary the extraction performance, all or individual fans can be activated as required. The individual fans can thus always be operated at an optimum rotational speed, determined in particular by the geometry of the fan wheels, at which they operate efficiently and quietly, wherein the extraction performance remains controllable by activating a reduced number of fans compared to the total number of fans.

The fume extractor device may have a filter for filtering cooking vapors. Due to the fact that a plurality of the fans are connected to each other via the negative pressure duct in an air-conducting manner, a number of the filters can be smaller than the number of fans. Thus, the fume extractor device is particularly easy to maintain and can be implemented in a compact manner. Preferably, the fume extractor device is configured such that each of the fans extracts the cooking vapors through each of the filters, in particular through one single filter.

In accordance with a further aspect of the invention, the filter is arranged in a vertical direction adjacent to the at least one inflow opening and/or to a cooking goods carrier, in particular a surface of the cooking goods carrier, and/or flush therewith. In a top view, the filter may be completely overlapped by the cooking goods carrier or may be arranged behind the cooking goods carrier. By arranging the filter in this way, the fume extractor device can be designed to be particularly space-saving and to have a particularly low installation height.

The filter can be glued to the cooking goods carrier and/or be connected with the cooking goods carrier via a filter receptacle, in particular in a form-fit manner, in particular via a rail. Preferably, the filter can be removed reversibly, in particular without tools, from the fume extractor device, in particular the cooking goods carrier. The filter may be designed as a grease filter. Preferably, an area of the filter covered by the cooking goods carrier in a top view is at least 50% of the area of the cooking goods carrier in the top view. An energy-efficient filtering of the cooking vapors is thus ensured.

The fume extractor device may have at least one cover for covering the at least one inflow opening. The cover may be arranged in parallel, in particular in a flush manner, with a surface of the cooking goods carrier. The cover may have a plurality of, in particular at least ten, in particular at least fifty, in particular at least one hundred, cover openings for the extraction of cooking vapors. The cover may be formed as a grille or as a metal mesh. The cover may have a glass, in particular a glass ceramic, or a metal, in particular a stainless steel. Preferably, the cover is adapted to cooking goods carrier, in particular in terms of color and/or structure, in such a way that they can hardly or not at all be distinguished from one another visually.

The filter may have the at least one cover and at least one filter element. The cover may be reversibly connected with the filter element. The filter may have a collection tray for collecting overflowing liquid. For example, the filter is triangular in cross-section.

According to one aspect of the invention, the fume extractor device has at least one fan motor which is connected to at least two, in particular at least three, of the fans, respectively, in a rotationally driving manner. Preferably, all of the fans are rotationally driven by means of one single fan motor. For this purpose, the fan motor can be in a rotation-transmitting connection with the respective fan wheel of the at least two, in particular at least three, fans via one or more rotation-transmitting means, in particular one or more gearboxes and/or a belt drive. The fan motor can be brought into rotation-transmitting connection with or decoupled from the fan wheels of the fans, in particular via a switchable coupling device. In general, the number of fan motors may be smaller than the number of fans, in particular smaller than the number of fan wheels. This aspect is also advantageous independently of the other details of the present invention.

According to another aspect of the invention, the fume extractor device comprises at least one odor filter, in particular an activated carbon filter, arranged in the negative pressure duct. Preferably, the filter is configured as a combination filter, wherein the combination filter comprises both a grease filter and an odor filter. The odor tilter arranged in the negative pressure duct is particularly easy to remove, in particular via the at least one inflow opening, in a reversible manner. The fume extractor device is thus particularly easy to maintain.

In accordance with a further aspect of the invention, at least two of the fans have rotational axes oriented obliquely to each other. This is to be understood that at least two of the fans have axes of rotation that are not parallel to each other. The axis of rotation of the at least one fan may be oriented vertically and/or horizontally. The axis of rotation of the at least one fan may also be arranged in an inclined manner to the vertical direction, wherein an angle to the vertical direction is greater than 5° and less than 85°. The axes of rotation of the at least two fans can be oriented radially with respect to the upstream negative pressure duct and/or with respect to a vertical axis extending, in particular, through the geometric center of area of the inflow opening. The at least two fans can thus be arranged at the negative pressure duct in a particularly space-saving manner. An angle between the axes of rotation of the at least two fans is preferably at least 30°, in particular at least 45°, in particular 90°.

According to yet another aspect of the invention, the fume extractor device comprises at least one guiding element adjacent to the at least one inflow opening and displaceable along a vertical direction for unilaterally shading an upper space located upstream of the at least one inflow opening. An upper space is understood to be a space above the fume extractor device, from which the cooking vapors are extracted downwardly by means of the fume extractor device. The guiding element is preferably plate-shaped. The at least one guiding element surrounds the at least one inflow opening on one side, that is, not completely. In a top view, the at least one guiding element surrounds the at least one inflow opening, in particular starting from a geometric center of area of the inflow opening, preferably over an angle of at least 30°, in particular at least 45°, in particular at least 90°, in particular at least 120°, in particular at least 180°. The extraction of the cooking vapors can thus be performed in a directed and particularly energy-efficient manner.

The effectiveness of the guiding element essentially depends on its height. Preferably, the at least one guiding element extends in the vertical direction starting from the at least one inflow opening upwards over at least 50 mm, in particular at least 100 mm, in particular at least 150 mm, in particular at least 200 mm.

The at least one guiding element can be flat or single-curved or double-curved, i.e. non-unwindable. The at least one guiding element is preferably circular in cross-section.

The at least one guiding element may have an illumination. The at least one guiding element may also have a user interface for controlling the at least one fan and/or the at least one hob.

Preferably, the at least one guiding element can be displaced relative to the at least one inflow opening. For this purpose, the fume extractor device can have a guide device, in particular a sliding guide. Preferably, the at least one guiding element can be arranged between a guiding position, in which the upper space is shaded on one side, and a reset position, in which the extraction of the cooking vapors is unaffected by the at least one guiding element.

In accordance with a further aspect of the invention, an upper side of the at least one guiding element in the reset position can be arranged below or flush with the inflow opening adjacent thereto. A region above the inflow opening can thus be used for depositing cooking goods without being impaired by the at least one guiding element.

Preferably, the guiding element comprises a closure element for closing, in particular airtightly, the at least one inflow opening in the reset position.

In the guiding position, the at least one guiding element covers the at least one inflow opening preferably at least partially in a top view. The extraction of the cooking vapors can thus be carried out in a more directed manner and thus particularly efficiently.

According to another aspect of the invention, the at least one inflow opening has an area of at most 100 $mm^2$, in particular at most 10 $mm^2$, in particular at most 1 $mm^2$, in particular at most 0.1 $mm^2$. A number of the inflow openings is preferably at least ten, in particular at least twenty-five, in particular at least fifty, in particular at least one hundred, in particular at least one thousand. The extraction of the cooking vapors can thus take place at a plurality of different positions and in the immediate vicinity of the place where the cooking vapors arise. The extraction of the cooking vapors is thus particularly efficient.

In accordance with yet another aspect of the invention, the plurality of inflow openings are each associated with one of at least two extraction sections, wherein extraction of the cooking vapors can be carried out independently via each of the extraction sections. The inflow openings of each of the at least two extraction sections may each be in communication with negative pressure ducts that are separated from each other in an airtight manner. Preferably, each of the at least two extraction sections is in air-conducting communication, in particular via a separate negative pressure duct in each case, with at least one fan each for aspirating the cooking fumes. Preferably, each of the at least two extraction sections comprises at least one, in particular at least two, in particular at least five, in particular at least ten, in particular at least fifty, inflow openings.

Another object of the invention is to improve a hob system.

This object is achieved by a hob system with a fume extractor device according to the above description and a hob for heating cooking goods. The advantages of the hob system according to the invention correspond to the advantages of the fume extractor device described above. Preferably, the hob comprises at least one cooking goods carrier and at least one heating unit arranged below the cooking goods carrier. The at least one heating unit may be designed as a radiation heating unit and/or as an induction heating unit. The at least one heating unit, in particular the induction coils, may each have a diameter or a length and width of up to 23 cm, in particular up to 24 cm, in particular more than 24 cm. The hob system may in particular have four hobs with a diameter or length and width of 24 cm each.

The at least one inflow opening, preferably in a top view, is arranged in the rear third, in particular in the rear quarter, of the hob system. The at least one inflow opening preferably extends over at least 50%, in particular at least 70%, in particular at least 85%, of the width of the hob system.

According to one aspect of the invention, the cooking goods carrier completely overlaps all of the fans in a top view. Thus, the horizontal dimensions of the hob system are particularly small.

According to a further aspect of the invention, in a top view, the fans are arranged in a region behind the rear edge of the cooking goods carrier. This makes it possible to design the hob system in the front region, in particular in the region of the hobs, which are also referred to as cooking zones, with a particularly low installation height. The hob system can have an installation height of at most 10 cm, in particular at most 5 cm, in particular at most 4 cm, in the front region, in particular over at least 50%, in particular at least 70%, in particular at least 80%, in particular at least 90% of its extension in the direction perpendicular to the front edge. These specifications for the installation height of the hob system apply in particular to the entire region in which the hobs are arranged. The hob system thus has such a low installation height in this region that the entire space in the base cabinet below can be used. In particular, there is no need to dispense with the top drawer. If necessary, the latter can be designed with a slightly reduced insertion depth.

In accordance with another aspect of the invention, the hob system has an L-shaped cross-section. In particular, it may have a lower installation height in its front region, in particular in the region where the hobs are arranged, than in the region of its rear edge. In this case, for example, electronic components and/or the fan(s), in particular the fan wheel(s), can be arranged in the region of the rear edge.

According to yet another aspect of the invention, the hob system may have an L-shaped cross-section in the transverse direction. In particular, it may have a greater installation height in one or both of its edge regions than in its central region. As a result, too, it can be achieved that the hob system has a particularly low installation height in its central region. In particular, it is possible to arrange electronic components and/or fans or their components and/or other components of the hob system in an edge region, in particular in a rear and/or a lateral edge region.

In accordance with one aspect of the invention, the filter, in a top view, is disposed between at least two of the hobs or behind the at least one hob.

According to one aspect of the invention, the at least one inflow opening is designed in a gas-permeable and liquid-repellent manner, in particular in a liquid-tight manner. For this purpose, a gas-permeable and liquid-repellent, in particular liquid-tight, layer can be arranged at the at least one inflow opening, in particular at the cooking goods carrier. The gas-permeable and liquid-repellent layer may be arranged above or below the cooking goods carrier. The gas-permeable and liquid-repellent layer may be attached to the cooking goods carrier and/or to the at least one filter, in particular in a materially bonded or replaceable manner. Preferably, the gas-permeable and liquid-repellent layer is designed to be cleanable, in particular dishwasher-proof.

This makes it possible to ensure that cooking vapors are reliably extracted downward, but that liquids cannot penetrate into a region below the cooking goods carrier and/or the at least one inflow opening.

The at least one inflow opening can in each case delimit an inflow duct penetrating the cooking goods carrier upstream. The at least one inflow duct can be formed as a bore, in particular as a micro-bore and/or as a perforation. Preferably, at least one of the inflow openings, in a top view, is arranged in a central region of the cooking goods carrier, in particular in the region of the geometric center of area of the cooking goods carrier. At least one of the inflow openings, in a top view, may be arranged in an edge region of the cooking goods carrier.

According to one aspect of the invention, the surface portion of a perforated surface of the cooking goods carrier as against the total surface area of the cooking goods carrier in a top view is at least 30%, particularly at least 50%, particularly at least 75%, particularly 100%.

In accordance with one aspect of the invention, the at least one cooking goods carrier is reversibly removable, in particular without tools, from a receptacle of the cooking goods carrier of the hob system.

The cooking goods carrier can in particular be designed as a separate constructive element that can be separated from the other components of the hob system. Together with the induction generators, it can also be separable, in particular removable, from the other components of the hob system.

The cooking goods carrier can be dishwasher-proof and/or designed for being cleaned in a pyrolysis process. In particular, the cooking goods carrier can be designed for this purpose as to be scratch-resistant and/or corrosion-resistant and/or heat-resistant, in particular for temperatures of at least 200° C., in particular at least 300° C., in particular at least 400° C., in particular at least 500° C.

The at least one cooking goods carrier may also be designed as a capacitive and/or electrically heatable warming plate, in particular one that can be removed without tools and/or carried. For electrical heating, the warming plate may have layers of micanite. Preferably, the warming plate can be heated up to a temperature of a maximum of 120° C., in particular a maximum of 100° C. in particular a maximum of 80° C. Preferably, the cooking goods carrier has a specific heat capacity of at least 500 J/kgK, in particular at least 700 J/kgK, in particular at least 850 J/kgK.

According to another aspect of the invention, the hob system is configured as a compact appliance. The compact appliance is to be understood to mean an assembly unit comprising the hob and the fume extractor device, wherein the fume extractor device comprises the negative pressure duct and the at least one fan. The hob system designed as a compact appliance can be installed particularly quickly and at low effort, in particular on a workplace.

In accordance with a further aspect of the invention, the at least one fan, in a top view, is arranged horizontally completely behind the geometric center of area of the hob system, in particular of cooking goods carrier. A total installation height of the hob system may thus be particularly low. When the hob system is mounted on a kitchen base cabinet, the storage space available below the workplace remains largely unaffected by the hob system, in particular in a front region. Preferably, the at least one fan, in the top view, is arranged completely in a region behind the cooking goods carrier. In this case, an axis of rotation of the at least one fan can be oriented horizontally, in particular in the depth direction of the hob.

According to another aspect of the invention, a front installation height of the hob system in a horizontal region between the front edge and a geometric center of area of the hob system is at most 180 mm, in particular at most 150 mm, in particular at most 120 mm, in particular at most 100 mm, in particular at most 80 mm, in particular at most 50 mm. It has been found that a hob system with an installation height of 40 mm in the front region is possible.

The hob system has such a low installation height, in particular in a region which extends over at least 30 cm, in particular at least 40 cm, in particular at least 50 cm starting from the front edge in the direction perpendicular to the latter.

The hob system may have such a low installation height, especially in the entire region of the cooking zones.

A total installation height of the hob system is preferably at most 250 mm, in particular 200 mm, especially 150 mm.

The invention is further based on the object of improving a hob system with a hob cover.

This object is achieved by a hob system in which the at least one heating unit overlaps a geometric center of area of the cooking goods carrier in a top view. According to the invention, it has been recognized that the hob system with the hob cover, which is displaceable relative to the hob and which, in the closed position, at least partially covers the at least one inflow opening and the at least one cooking zone in a top view and, in the open position, exposes them, can be used particularly flexibly and intensively. A cooking zone is defined as a region above the cooking goods carrier in which the at least one heating unit heats the cooking goods.

When the hob cover is arranged in the open position, the entire hob can be used in the usual manner for heating the cooking goods. When the hob cover is arranged in the closed position, a first region above the hob can be used, for example, for heating cooking goods, wherein a second region above the hob can be used at the same time for preparing the cooking goods. Due to the at least partial covering of the at least one inflow opening, the extraction intensity is increased, in particular with unchanged fan power, in the uncovered region of the inflow opening. Thus, an increased extraction performance can be provided in the region of the hob used for cooking. In addition, the hob cover arranged in the open position can reliably protect a wall behind it from grease splashes. An intensive use of the space available in a kitchen and an energy-efficient extraction of cooking vapors are thus made possible.

According to a further aspect of the invention, the hob cover in the closed position covers only the at least one inflow opening, but not the cooking zones. In particular, the hob cover can be in particular flush with a rear edge of the hobs, in particular of the cooking goods carrier, in the closed position.

An upper side of the hob cover can be designed as a mechanically insensitive, in particular scratch-resistant storage surface and/or cut-resistant cutting surface. When the hob cover is arranged in the closed position, the upper side of the hob cover can then be used, for example, for preparing food to be heated. Preferably, the hob cover is designed to be resistant to high temperatures, in particular to temperatures of at least 150° C., in particular at least 200° C., in particular at least 250° C. The hob cover can have a particularly low thermal conductivity of at most 3.0 W/mK, in particular at most 2.0 W/mK, in particular at most 1.0 W/mK. Heated food can thus be placed on the hob cover without the risk of damage to the hob cover and without the risk of burning the skin on the heated hob cover.

In particular, the hob cover can be made of metal, especially cast iron, glass or glass ceramic, or plastic material.

The hob cover is preferably pivotally mounted to the hob system, in particular to the hob. The hob cover may be in communication with a drive means for displacing the hob cover between the closed position and the open position. The drive means may comprise a motor and/or a spring element. The hob cover can thus be displaced particularly easily, in particular automatically, between the closed position and the open position. For manual displacement between the open position and the closed position, the hob cover can have a handle means.

Preferably, the hob cover completely covers the at least one inflow opening and/or the at least one cooking zone in the closed position. In the closed position, the hob cover may completely overlap the entire hob, in particular the entire cooking goods carrier, in a top view. In the closed position, the hob cover can rest on the hob, in particular on the cooking goods carrier. In the closed position, a surface of the hob cover can be arranged flush with a workplace or project upwardly beyond it.

According to one aspect of the invention, the hob cover closes the at least one inflow opening in the closed position in an airtight manner. The hob cover may comprise a closure seal for this purpose. Preferably, the closure seal completely surrounds the at least one inflow opening in the closed position. The escape of odors from the fume extractor device through the at least one inflow opening can thus be reliably prevented, in particular when the fans are deactivated.

According to another aspect of the invention, the hob cover comprises at least two independently displaceable cover bodies. Preferably, the at least one inflow opening and the cooking goods carrier can each be partially covered by the at least two cover bodies. Unused areas of the cooking goods carrier can thus be covered together with a, in particular adjacent, partial region of the at least one inflow opening, wherein in particular a further partial region of the cooking goods carrier can be used for heating cooking goods. The cooking vapors can be extracted particularly intensively via the thus reduced region of the inflow opening.

The bob cover may have at least one closure lid attached to the at least one cover body. The closure lid may be configured such that, in the closed position of the at least one cover body, the closure lid penetrates into a negative pressure duct of the fume extractor device. The closure seal is preferably arranged at the at least one closure lid. The at least one inflow opening can thus be closed particularly reliably, in particular in an airtight manner.

Further features, advantages and details of the invention will be apparent from the following description of the cooking goods carrier, the hob and the hob system based on the figures.

DESCRIPTION OF THE PREFERRED EMBODIMENTS

Figure 1:
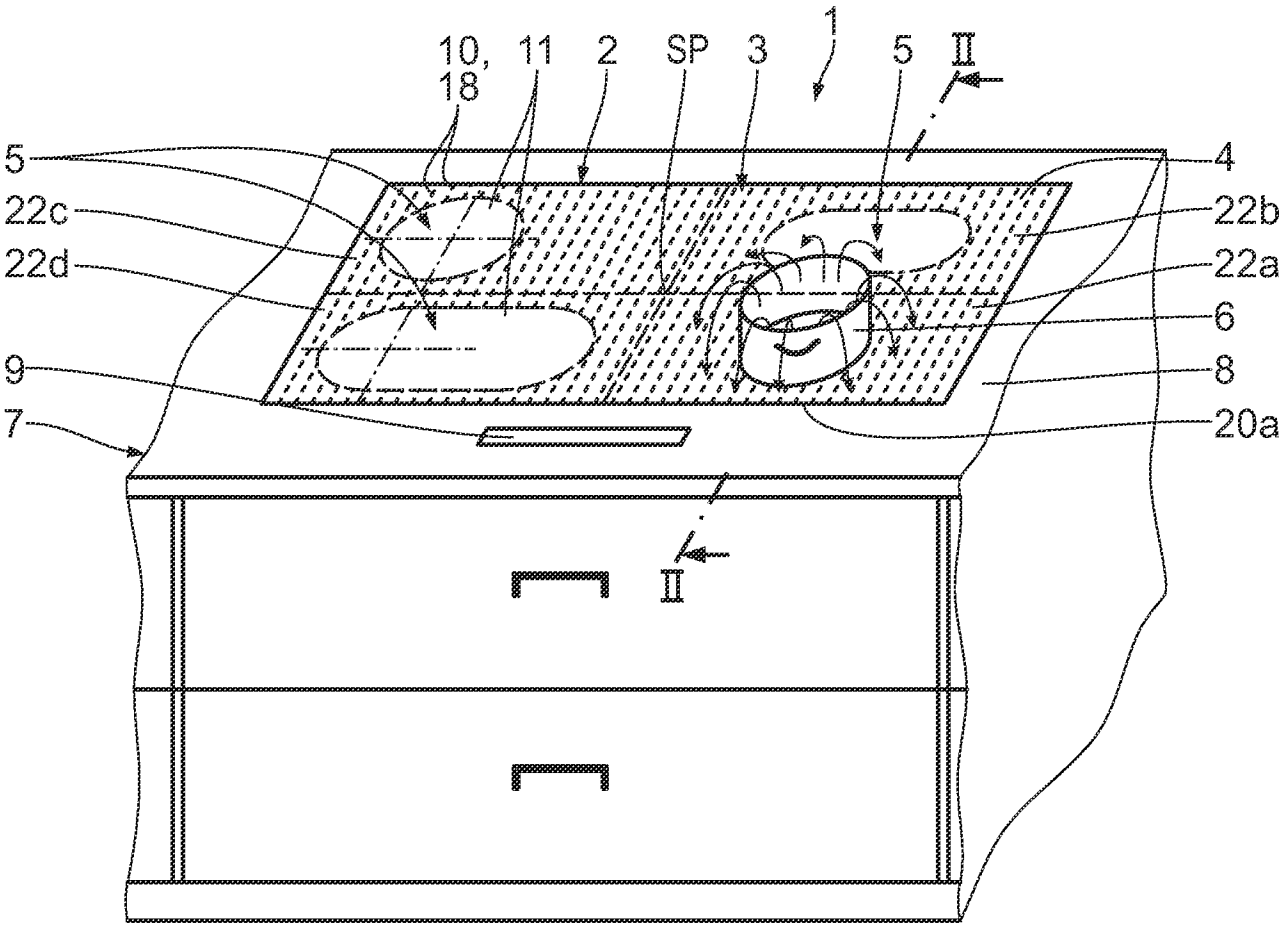
FIG. 1 shows a perspective view of a hob system with a hob and a fume extractor device.

In the following, different details of a hob system 1 with a hob 2 and a fume extractor device 3 are described with reference to FIG. 1 and FIG. 2. The hob 2 comprises a cooking goods carrier 4 with four heating units 5 arranged thereat for heating cooking goods 6. The hob system 1 is arranged on a kitchen base cabinet 7. For this purpose, the hob system 1 is attached to a workplace 8 of the kitchen base cabinet 7. A surface of the cooking goods carrier 4 is arranged flush with a surface of the workplace 8.

For controlling the fume extractor device 3 and the heating units 5, the hob system 1 comprises a user interface 9. The user interface 9 is designed as a touch-sensitive screen. The user interface 9 is in signal communication with the fume extractor device 3 and the heating units 5 via a control unit, not shown.

The cooking goods carrier 4 comprises a glass plate, in particular a glass ceramic plate. The glass plate is penetrated by a plurality of inflow ducts 10 for the extraction of the cooking vapors. A cross-sectional area of the inflow ducts 10 is less than 1 $mm^2$ in each case.

A region that can be heated by the respective heating unit 5 at the level of or above the cooking goods carrier 4 forms a cooking zone 11. In the region of the cooking zones 11, the respective heating unit 5 can act on the cooking goods 6 and heat it. In the region of the cooking zones 11, the cooking goods carrier 4 does not have any inflow ducts 10. With the exception of the region of the cooking zones 11, the inflow ducts 10, in a top view, are arranged equidistantly from one another at the cooking goods carrier 4. The inflow ducts 10 each extend in a straight line and in a vertical direction through the cooking goods carrier 4. The inflow ducts 10 have a circular cross-section.

Figure 2:
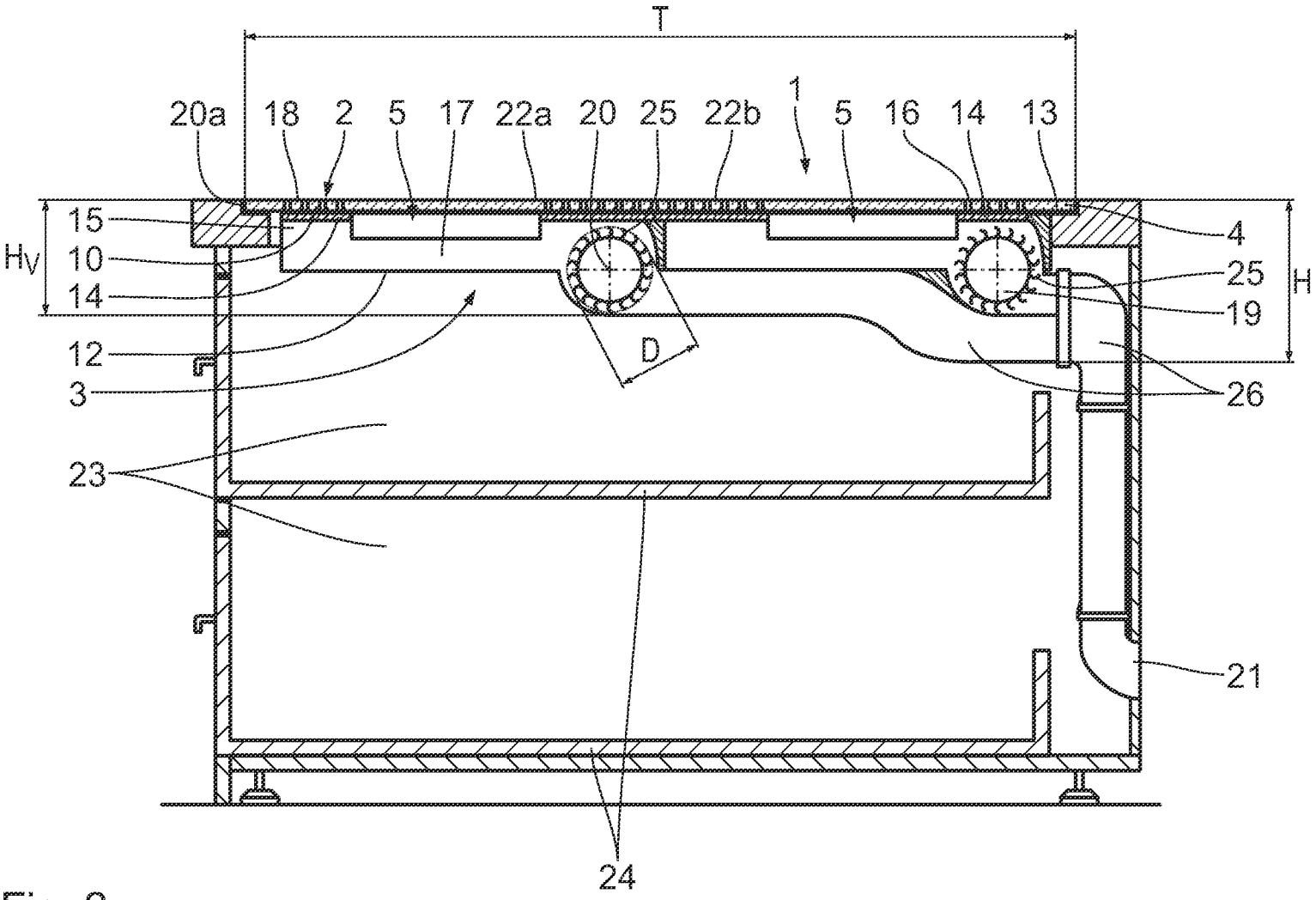
FIG. 2 shows a sectional view of the hob system along the section line 11-11 in FIG. 1.

As shown in FIG. 2, the hob system 1 has a housing 12. A receptacle of the cooking goods carrier 13 is arranged at the housing 12. The cooking goods carrier 4 rests on the receptacle of the cooking goods carrier 13 from above and can be removed upwardly from the latter without tools and in a reversible manner. The receptacle of the cooking goods carrier 13 has a tilting edge which is not shown. The tilting edge delimits a supporting surface of the receptacle of the cooking goods carrier 13 from a recess. The recess is designed in such a way that by loading cooking goods carrier 4 in a region above the recess in the downward direction, a lifting of a region of the cooking goods carrier 4 opposite to the tilting edge can be achieved.

The cooking goods carrier 4 is designed in a dishwasher-proof manner. In particular, the cooking goods carrier 4 is designed to be resistant to high temperatures, in particular temperatures of at least 350° C., and suitable for pyrolysis cleaning.

The number of inflow ducts 10 penetrating the cooking goods carrier 4 is greater than 50. Below the cooking goods carrier 4, in particular in the areas penetrated by the inflow ducts 10, a filter 14 is arranged. In a top view, the filter 14 completely overlaps the inflow ducts 10. The filter 14 is designed as a combination filter for filtering grease and odors from the cooking vapor. The cooking goods carrier 4 has a filter receptacle 15. The filter 14 is reversibly attached to the cooking goods carrier 4 by means of the filter receptacle 15.

The cooking goods carrier 4 is permeable to gases and impermeable to liquids. For this purpose, the cooking goods carrier 4 has a hydrophobic surface coating 16 in the region of the inflow ducts 10.

The filter 14 is arranged in a negative pressure duct 17 of the fume extractor device 3. The negative pressure duct 17 extends between inflow openings 18, which are formed by the inflow ducts 10 on the upper side of the cooking goods carrier 4, and fans 19 of the fume extractor device 3. The fume extractor device 3 comprises four fans 19. The fans 19 are designed as cross-flow fans. An axis of rotation 20 of the respective fan 19 is oriented horizontally, in particular in parallel to a front edge 20*a* of the hob system 1. The fans 19 are in fluid-conducting communication with the inflow openings 18 via the negative pressure duct 17 and in fluid-conducting communication with a cooking vapor outlet 21 via a positive pressure duct 21.

The fume extractor device 3 is designed to extract cooking vapors via four independently operable extraction sections 22*a*, 22*b*, 22*c*, 22*d*. For this purpose, the respective extraction section 22*a*, 22*b*, 22*c*, 22*d* is in communication with one of the fans 19 via a separate negative pressure duct 17. The surface of the cooking goods carrier 4 is divided into four extraction sections 22 of equal area.

Sealing elements, which are not shown, are arranged at the negative pressure duct 17 for the airtight connection of the negative pressure duct 17 arranged downstream of the respective extraction section 22 with the cooking goods carrier 4. The sealing elements thereby completely surround the respective extraction sections 22.

The cooking goods carrier 4 has a depth T of 500 mm. In the front region, in particular over at least 70% of the depth T, starting from a front edge 20*a* of the hob system 1, the hob system 1 has a front installation height $H_V$ of 120 mm or less. The installation height $H_V$ of the hob system 1 may in particular be in the range of only 3 cm to 5 cm in this region. A storage space 23 of the kitchen base cabinet 7 remains largely unaffected and unobstructed by the hob system 1. A top drawer 24 of the kitchen base cabinet 7 is not shortened either in the vertical direction or in the depth direction. If necessary, it is possible to configure the top drawer 24 of the kitchen base cabinet 7 a bit shorter in the depth direction in order to have sufficient space available in the rear region for arranging the fans 19.

The fans 19 each have a fan wheel 25. A diameter D of the fan wheels 25 is 80 mm.

The hob system 1 is designed as a compact appliance and can thus be easily and quickly inserted into the workplace 8 as a preassembled system. The hob system 1 designed as a compact appliance thereby comprises the housing 12, the hob 2 and the fume extractor device 3, wherein the negative pressure duct 17 and the fans 19 of the fume extractor device 3 are complete with the compact appliance, whereas the positive pressure duct 26 arranged downstream of the fans 19 is only partially associated with it.

The mode of operation of the hob system 1, the fume extractor device 3, the hob 2 and the cooking goods carrier 4 is as follows:

The start-up of the hob system 1 is carried out via the user interface 9. User inputs for controlling the heating units 5 and the fans 19 are transmitted to the control unit via the user interface 9. By means of the control unit, electrical energy is provided to operate the heating units 5 and the fans 19. Via the control unit, status and performance data of the heating units 5 and the fans 19 are transmitted to the user interface 9 and visually displayed via the user interface 9.

The heating units 5 and the fans 19 can be switched with electrical power independently of one another by means of the control unit. By activating the heating unit 5 arranged in the region of the extraction section 22*a*, exclusively the cooking goods 6 arranged there is heated. By activating the fan 19 connected with the extraction section 22*a*, cooking vapors are drawn off via the inflow ducts 10 associated with the extraction section 22*a*.

Figure 3:
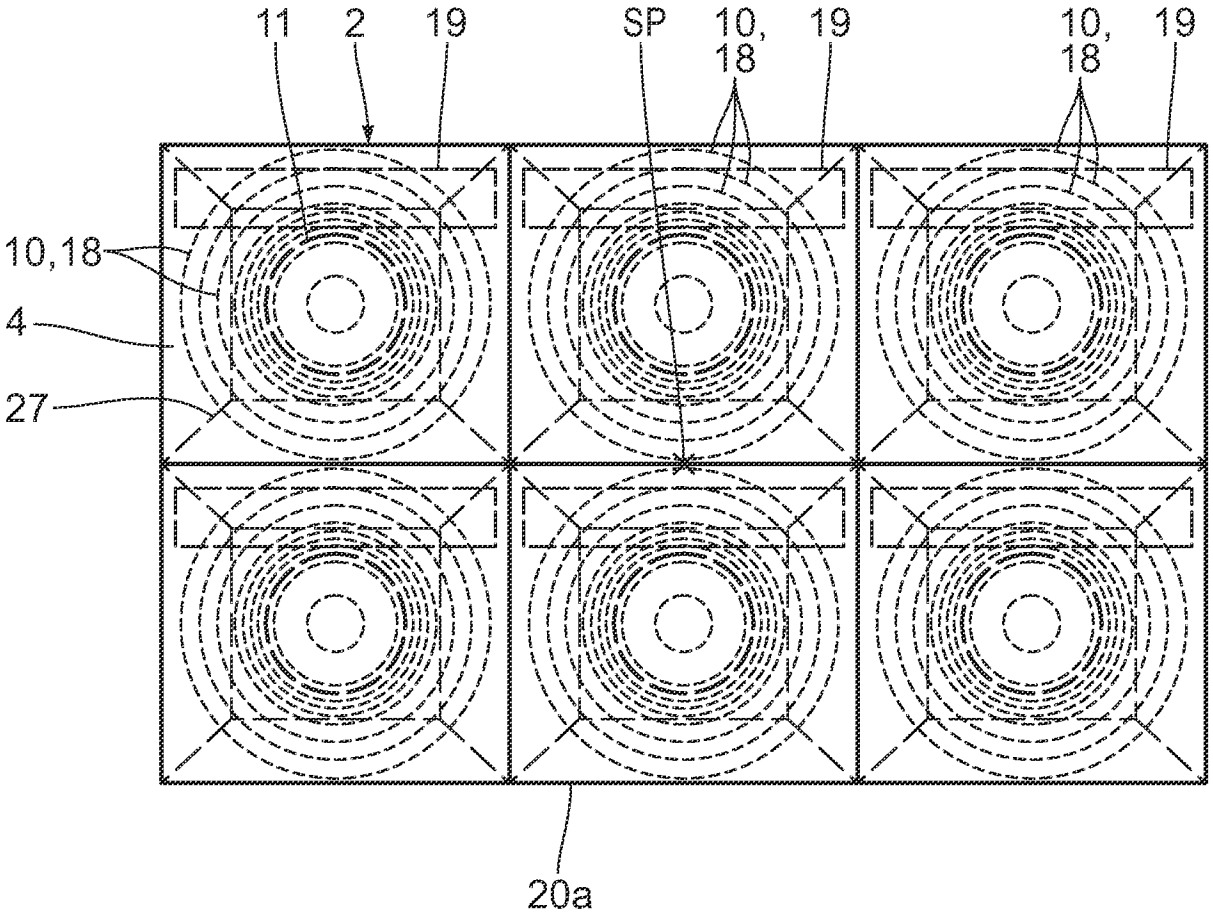
FIG. 3 shows a top view onto a hob system according to a further embodiment, according to which the hob system comprises six induction heating units, a fume extractor device with a plurality of cross-flow fans and a cooking goods carrier with a plurality of inflow ducts, wherein these are distributed inhomogeneously over a surface of the cooking goods carrier.

With reference to FIG. 3, a further embodiment of the hob system 1 according to the invention is described below. In contrast to the preceding embodiment, the inflow ducts 10 are arranged in an inhomogeneously distributed manner over a surface of the cooking goods carrier 4. In addition, inflow ducts 10 are also arranged in the region of the cooking zones 11. The negative pressure duct 17 in this case extends in particular between the heating unit 5 and the cooking goods carrier 4. For this purpose, the heating unit 5 is arranged at a distance from the cooking goods carrier 4. A number of the inflow ducts 10 per unit area is greater in an edge region of the respective cooking zone 11 than in a center region of the respective cooking zone 11, and greater than in an edge region of the cooking goods carrier 4. A cross-sectional area of the inflow ducts 10 varies according to the position of the respective inflow duct 10 relative to the cooking zone 11. The inflow ducts 10 arranged in an edge region of the cooking zone 11 have a larger cross-sectional area than those inflow ducts 10 in the center region of the cooking zone 11 and in the edge region of the cooking goods carrier 4.

The inflow ducts 10 are designed to be permeable to gases and liquids. A collection tray 27 for overflowing liquids is arranged below the cooking goods carrier 4. In a top view, the collection tray 27 overlaps a plurality of the inflow ducts 10.

The hob system 1 comprises six hobs 2, each with a cooking goods carrier 4. The carriers for food to be cooked 4 of the respective hobs 2 are formed separately from one another.

The mode of operation of the hob system 1 according to the embodiment shown in FIG. 3 corresponds to the mode of operation of the hob system 1 according to the embodiment described above. Due to the fact that the hob system 1 comprises a plurality of hobs 2 with only a single heating unit 5, the dimensions of the carriers for food to be cooked 4 are correspondingly small. The carriers for food to be cooked 4 can thus be removed particularly easily from the respective receptacle of the cooking goods carrier 13 and cleaned, in particular in a dishwasher.

After removing the carriers for food to be cooked 4 from the respective receptacle of the cooking goods carrier 13, the collection trays 27 can be easily cleaned from above. The filter 14 arranged on the respective cooking goods carrier 4 can be cleaned or replaced particularly easily.

Figure 4:
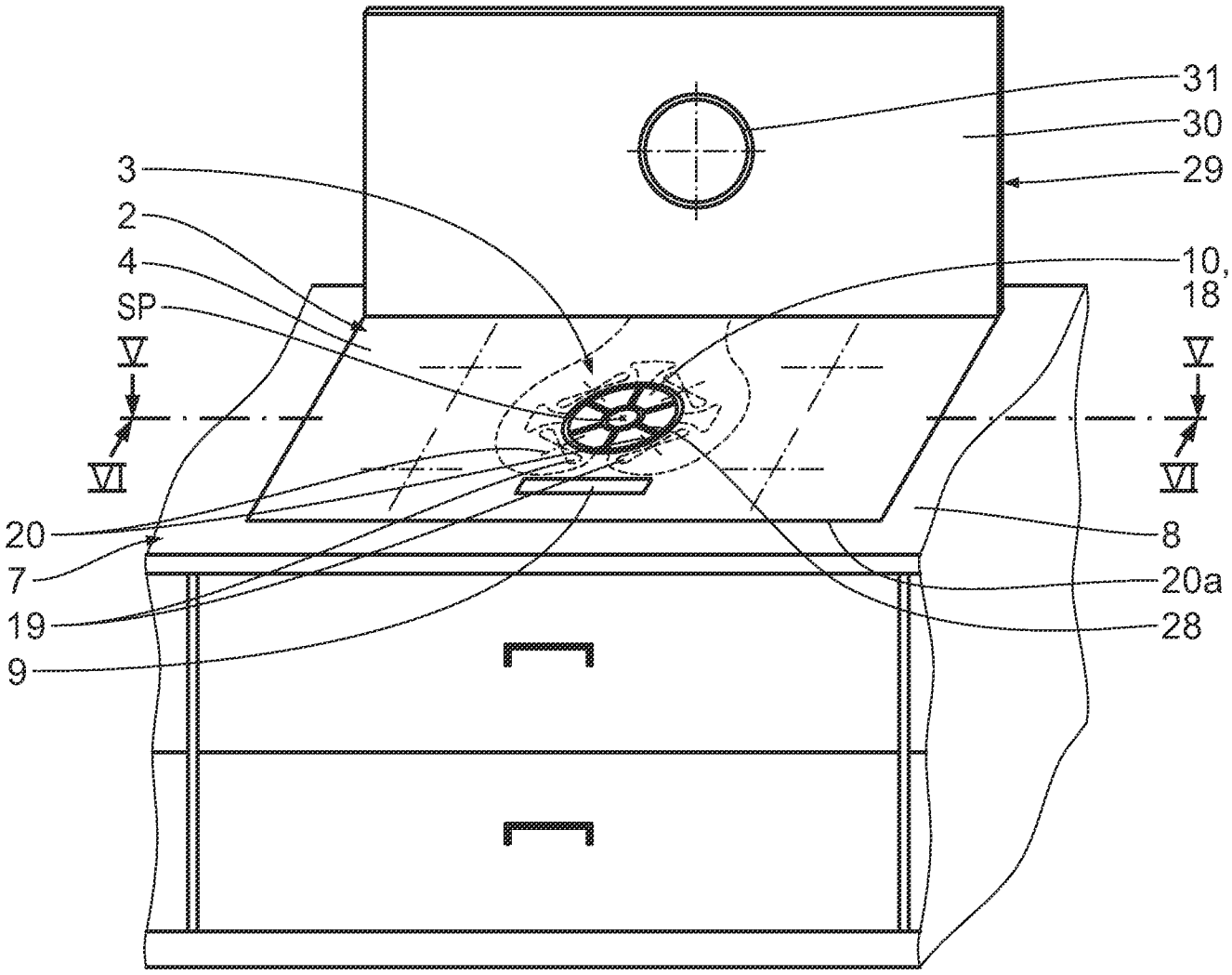
FIG. 4 shows a perspective view of a hob system according to a further embodiment system, comprising a fume extractor device with a single inflow opening formed by a cooking goods carrier and a hob cover for reversibly and completely covering the cooking goods carrier and the inflow opening.
Figure 5:
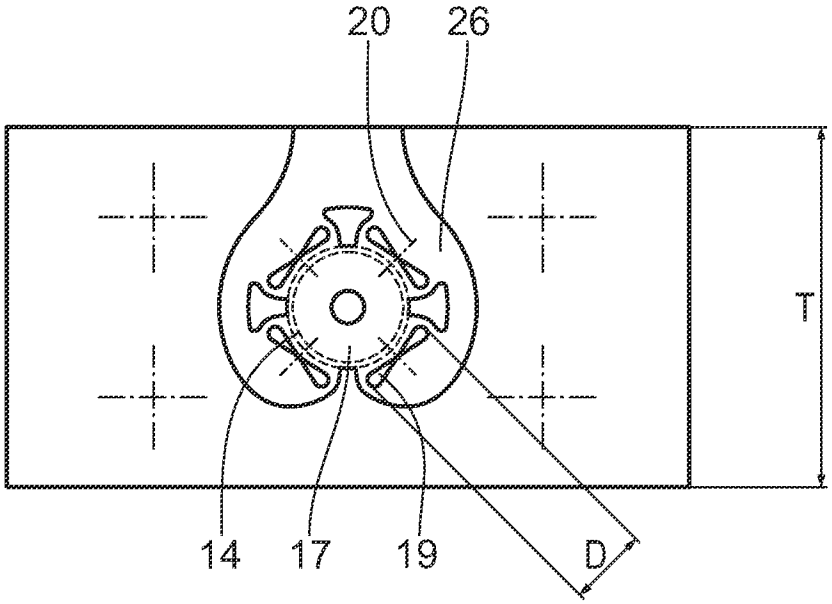
FIG. 5 shows a sectional view of the bob system along the section line V-V in FIG. 4 with four fans arranged equiangularly and equidistantly about a vertical axis running through a center of area of the inflow opening.
Figure 6:
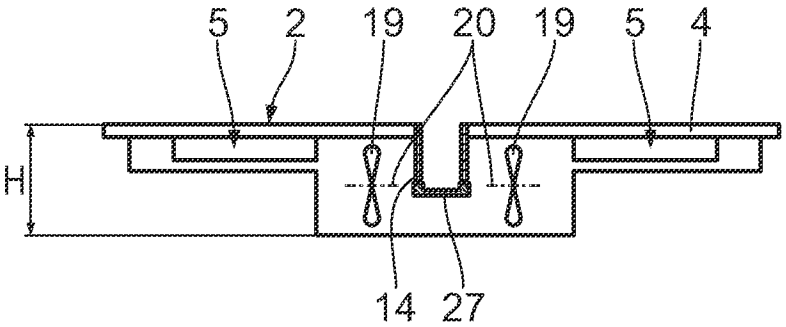
FIG. 6 shows a sectional view of the hob system along the section line VI-VI in FIG. 4 with a hollow cylindrical filter.

With reference to FIG. 4 to FIG. 6, a further embodiment of the invention is described. In contrast to the embodiments described above, the cooking goods carrier 4 has a single inflow duct 10. An upper side of the inflow duct 10 forms the single inflow opening 18 of the fume extractor device 3. The inflow opening 18 is covered by an inflow grille 28.

The hob system 1 comprises a hob cover 29 for reversibly covering the cooking goods carrier 4 and the inflow opening 18. The hob cover 29 comprises a cover body 30 that is displaceable relative to the cooking goods carrier 4. The cover body 30 can be arranged in a closed position and in an open position. In the closed position, the cover body 30 completely covers the cooking goods carrier 4 and the inflow opening 18 in a top view. The cover body 30 comprises a closure seal 31 for airtight closure of the inflow opening 18 in the closed position.

The hob cover 29 is hinged to the hob 2. In the open position, the hob cover 29 exposes the cooking goods carrier 4, in particular the cooking zones 11, for heating the cooking goods, as well as the inflow opening 18 for extracting cooking vapors.

The surface of the cooking goods carrier 4 is arranged flush with the surface of the workplace 8. In the closed position, the cover body 30 rests on the edge of the workplace 8. According to an alternative embodiment not shown, the surface of the cooking goods carrier 4 may be arranged below the surface of the workplace 8 and a surface of the hob cover 29 may be arranged flush with the surface of the workplace 8 in the closed position.

FIG. 5 shows a section of the hob system 1 from below. The fume extractor device 3 of the hob system 1 comprises four fans 19. The fans 19 have a horizontally oriented axis of rotation 20. In a top view, the fans 19 are arranged in an equidistantly and equiangularly distributed manner around a vertical axis extending through a center of area of the inflow opening 18. The rotational axes 20 of respectively two mutually adjacent fans 19 are oriented at an angle of 90° to each other. The diameter D of the fan wheels 25 is 120 mm. The fans 19 are designed as axial fans.

The fans 19 are connected with the inflow opening 18 via a common negative pressure duct 17. The fume extractor device 3 comprises a positive pressure duct 26 connecting the fans 19 in a fluid-conducting manner.

As shown in FIG. 6, a total installation height H of the hob system is 150 mm. Downstream of the inflow opening 18, a hollow cylindrical filter 14 with a collection tray 17 for overflowing liquids is arranged. The filter 14 is designed as a grease filter.

The mode of operation of the hob system 1 according to the embodiment shown in FIGS. 4 to 6 corresponds to the mode of operation of the hob system 1 according to the preceding embodiments. The inflow grille 28 is reversibly removable from the cooking goods carrier 4. The filter 14 can be removed from the inflow opening 18. The hob cover 29 can be pivoted between the closed position and the open position. The cooking goods carrier 4 is firmly connected with the workplace 8.

Figure 7:
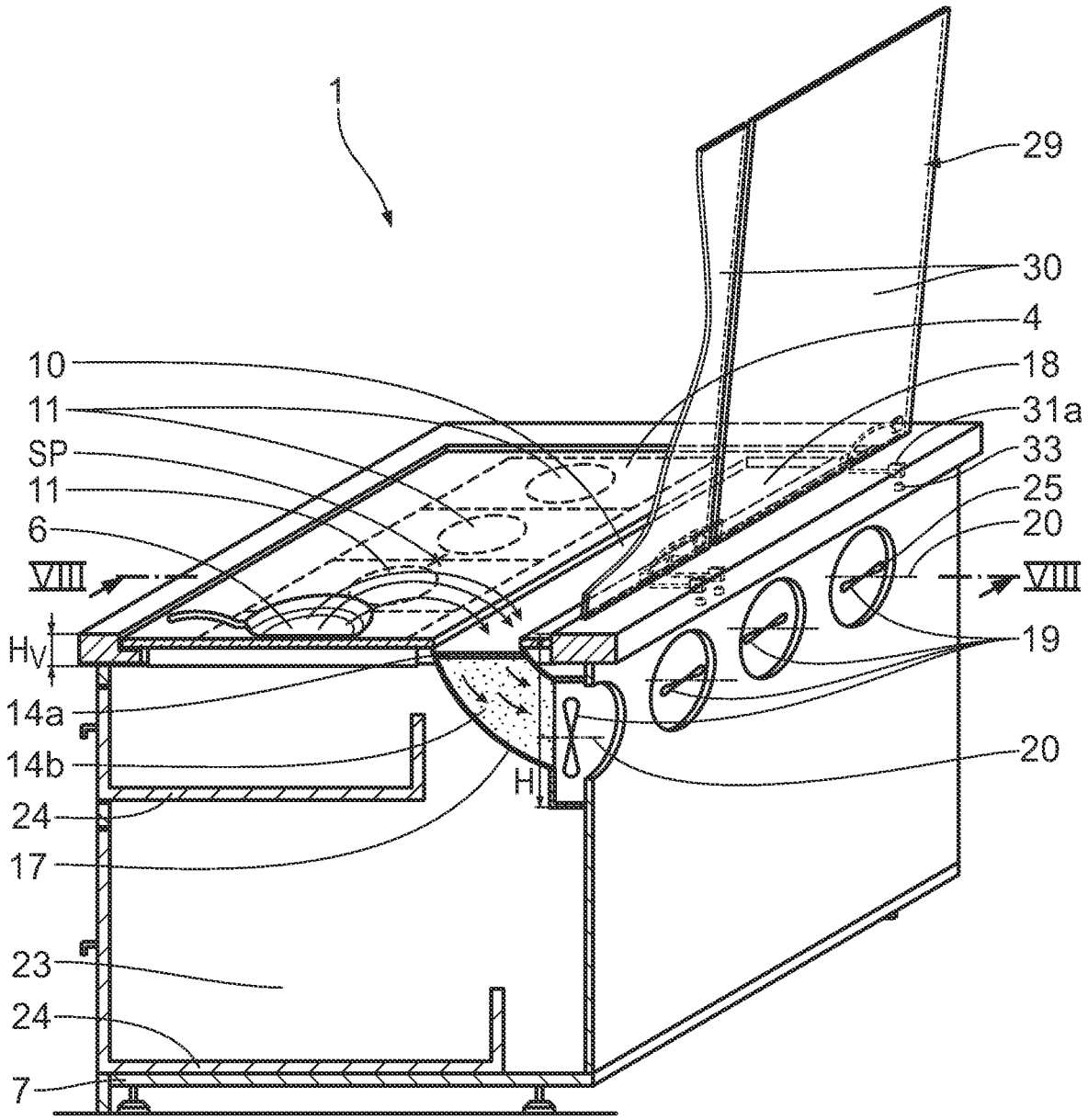
FIG. 7 shows a perspective rear view of a hob system according to a further embodiment, wherein the hob system has a hob with four heating units arranged next to one another, a hob cover with two cover bodies that can be displaced independently of one another, and a fume extractor device with an inflow opening arranged on the rear side of the hob.
Figure 8:
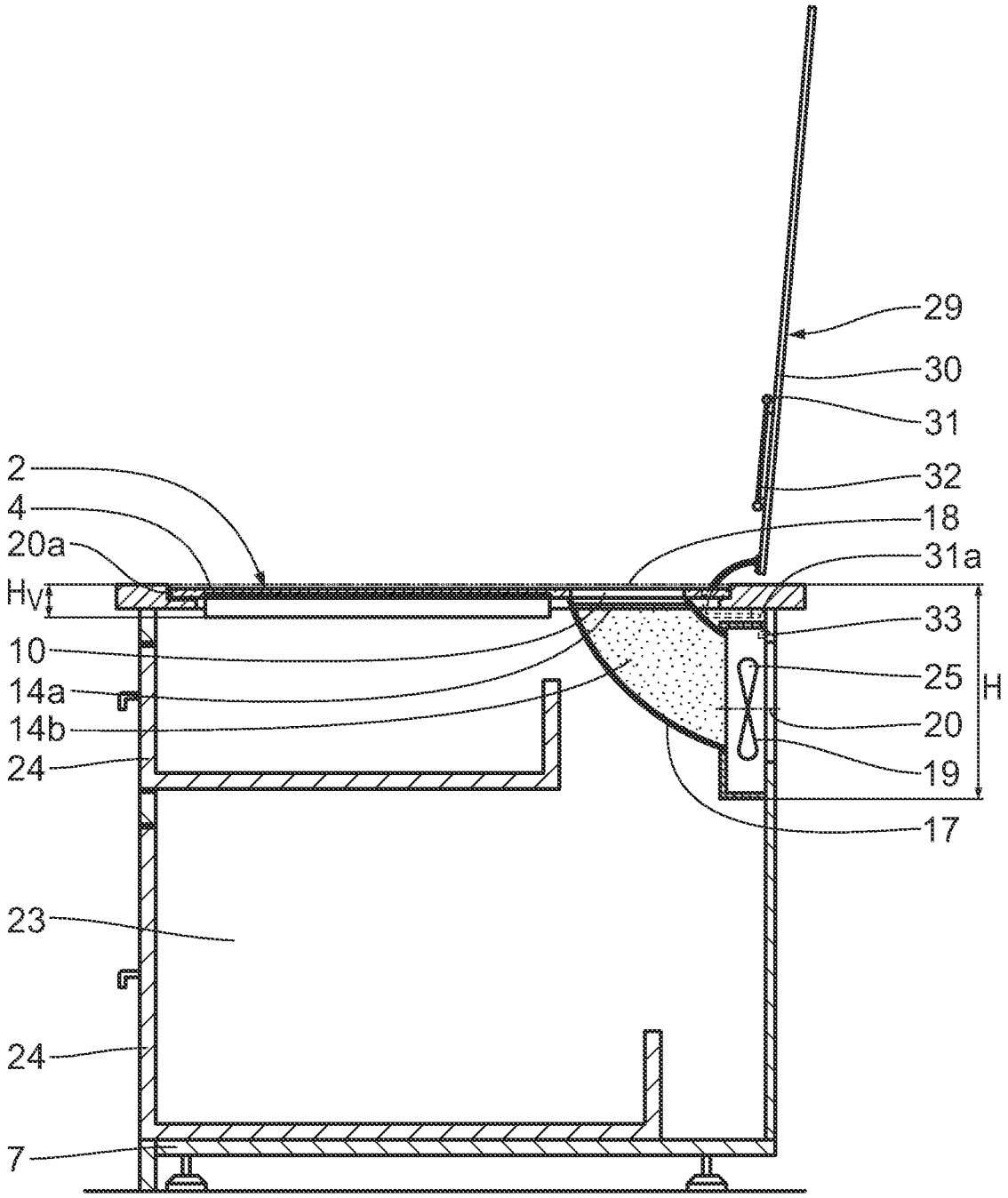
FIG. 8 shows a sectional view of the hob system along the section line VIII-VIII in FIG. 7, wherein an odor filter of the extractor device is arranged in a negative pressure duct disposed upstream of the fans.

With reference to FIG. 7 and FIG. 8, a further embodiment of the invention is described. In contrast to the preceding embodiments, the hob system 1 comprises a hob 2 with four heating units 5 arranged side by side. An inflow opening 18 of the fume extractor device 3 has a rectangular contour and is arranged behind the heating units 5 or the cooking zones 11. The inflow opening 18 is in air-conducting communication with four fans 19, each of which has a fan wheel 25, via a negative pressure duct 17. The axes of rotation 20 of the fan wheels 25 are parallel to each other and horizontally oriented.

A maximum front installation height $H_V$ in a horizontal region from a front edge 20*a* to a geometric center of area SP of the hob system 1 is 120 mm or less. In particular, the installation height $H_V$ of the hob system 1 in this region may be in the range of only 3 cm to 5 cm. In particular, the hob system 1 has such a low installation height starting from its front edge 20*a* over a depth T of at least 30 cm, in particular at least 40 cm. A total installation height H of the hob system 1 is 180 mm or less.

The hob cover 29 has two cover bodies 30. The two cover bodies 30 can be arranged independently of one another between the open position and the closed position. In the closed position, each of the cover bodies 30 completely covers two of the cooking zones 11, respectively, and covers the inflow opening 18 in a half-sided manner.

The two cover bodies 30 are each attached to the hob system 1 via a rotary mechanism 31*a*. The rotary mechanism 31*a* has a drive spring, which is not shown, and a damper element, which is also not shown. The rotary mechanism 31*a* ensures a smooth and dampened-in-motion opening and closing of the respective cover body 30.

As shown in FIG. 8, the fume extractor device 3 comprises two filters 14*a*, 14*b* arranged in the negative pressure duct 17. The first filter 14*a* arranged downstream of the inflow opening 18 in the flow direction is designed as a grease filter, and the second filter 14*b* is designed as an odor filter. In particular, an activated carbon filter serves as an odor filter. The second filter 14*b* may in particular have one or more activated carbon elements. These can be exchanged in a simple manner. In particular, they may be removable through the inflow opening 18.

Alternatively or in addition to the second filter 14*b* in the negative pressure duct 17, an odor filter, in particular in the form of an activated carbon filter, may be arranged on the downstream side of at least one of the fans 19. In particular, it is possible to arrange a corresponding odor filter on the downstream side to each of the fans 19. These odor tilters are preferably replaceable, in particular replaceable without tools. In particular, they may be removed from the positive pressure duct 26 via respective removal openings provided.

The hob cover 29 each includes one closure lid 32 connected with the cover body 30 for airtight closure of the inflow opening 18. The cover body 30 is spaced from the closure lid 32.

The mode of operation of the hob system 1 corresponds to the mode of operation of the hob system 1 according to the previously mentioned embodiments. Due to the relative displaceability of the cover bodies 30 with respect to each other, the inflow opening 18 can optionally not be covered at all, be covered in a half-sided manner or completely. In the case of half-sided covering of the inflow opening 18, the extraction performance in the uncovered region of the inflow opening 18 is increased while the performance of the fans 19 remains the same. The uncovered cooking zones 11 can still be used for heating cooking goods 6. The cooking zones 11 covered by the cover body 30 are automatically deactivated. For this purpose, the control unit is in signal communication with contact switches 33 for detecting the cover body 30 arranged in the closed position.

Figure 9:
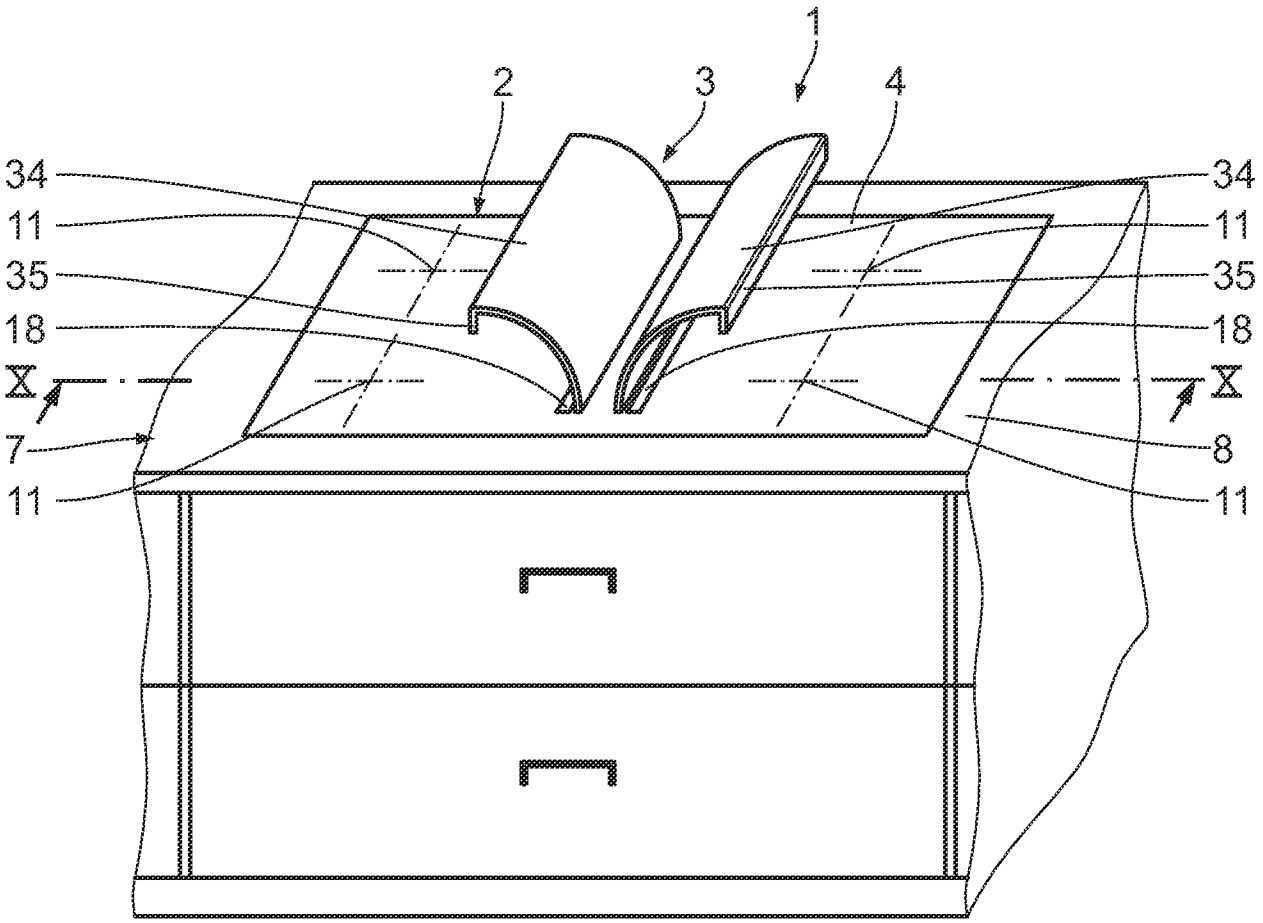
FIG. 9 shows a perspective view of a hob system according to a further embodiment with two displaceable cooking vapor guiding elements for shading an upper space located upstream of an inflow opening on one side in each case.
Figure 10:
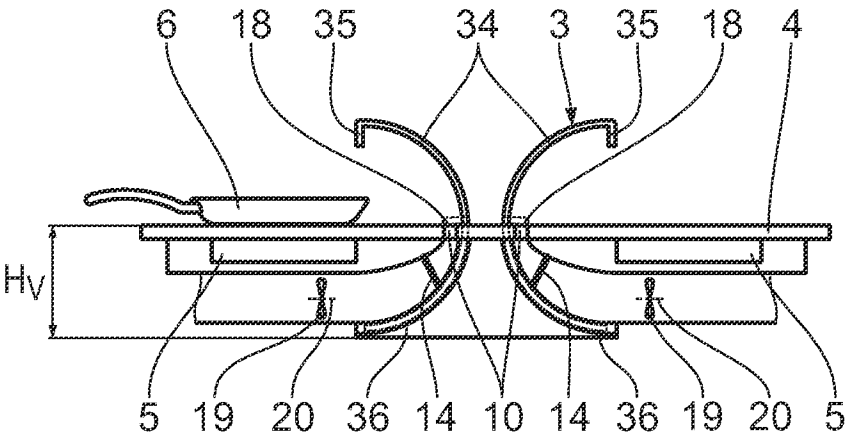
FIG. 10 shows a sectional view of the hob system along the section line X-X in FIG. 9, with two fans disposed downstream of the two inflow openings.

With reference to FIG. 9 and FIG. 10, a further embodiment of the invention is described. In contrast to the previous embodiments, the fume extractor device 3 comprises two inflow openings 18, which are formed by two inflow ducts 10 penetrating the cooking goods carrier 4. The fume extractor device 3 also comprises two guiding elements 34, which are each arranged adjacent to the inflow openings 18 and are oriented in parallel to a main extension of the inflow openings 18. The guiding elements 34 are each formed as a single curved shell. The guiding elements 34 are displaceable relative to the cooking goods carrier 4 between a reset position and a guiding position. In the guiding position, the respective guiding element 34 is arranged at least in portions above the cooking goods carrier 4. In the guiding position, the respective guiding element 34 shades an upper space, located upstream of the respective inflow opening 18, on one side with respect to the inflow opening 18. In the reset position, an upper side of the respective guiding element 34 is arranged flush with the surface of the respective inflow opening 18 adjacent thereto.

The guiding elements 34 have a closure element 35. The closure element 35 is designed to cover the respective inflow opening 18 in the reset position.

As shown in FIG. 10, the hob system 1 has one sliding guide 36 each for displacing of the guiding elements 34.

The mode of operation of the hob system 1 shown in FIG. 9 and FIG. 10 corresponds to the mode of operation of the hob system 1 according to the embodiments described above. The displacement of the respective guiding element 34 along the sliding guide 36 enables a one-sided shading of the upper space for the directed extraction of the cooking vapors in the guiding position and a closure of the respective inflow opening 18 in the reset position, wherein an escape of odors from the fume extractor device 3 is reliably prevented.

Figure 11:
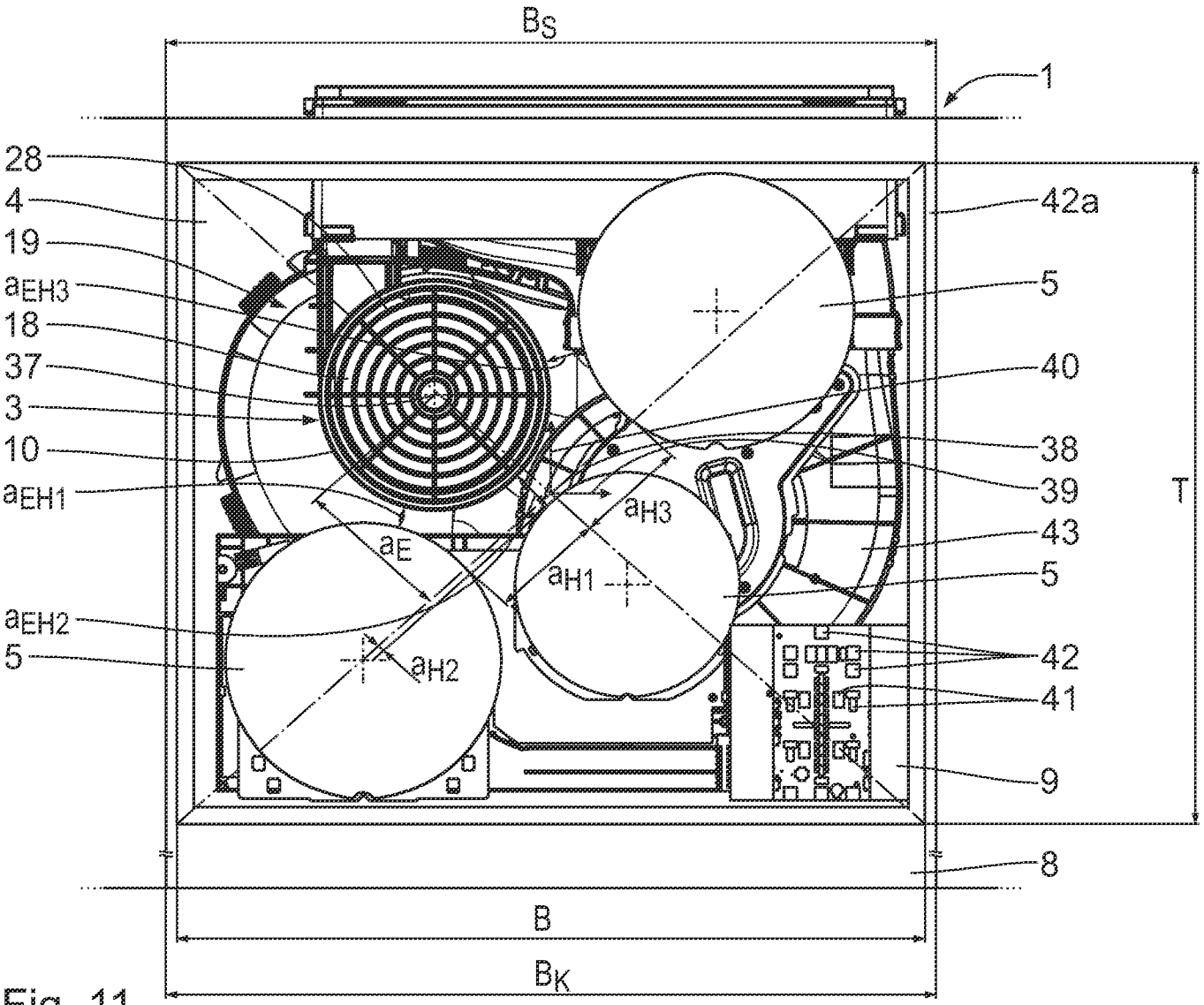
FIG. 11 shows a top view onto a hob system according to a further embodiment with a cooking goods carrier, three heating units arranged thereat and a fume extractor device for extracting cooking vapors downward, wherein a total width of the hob system is 560 mm and wherein all of the heating units are arranged at the same distance from the inflow opening in a top view.
Figure 12:
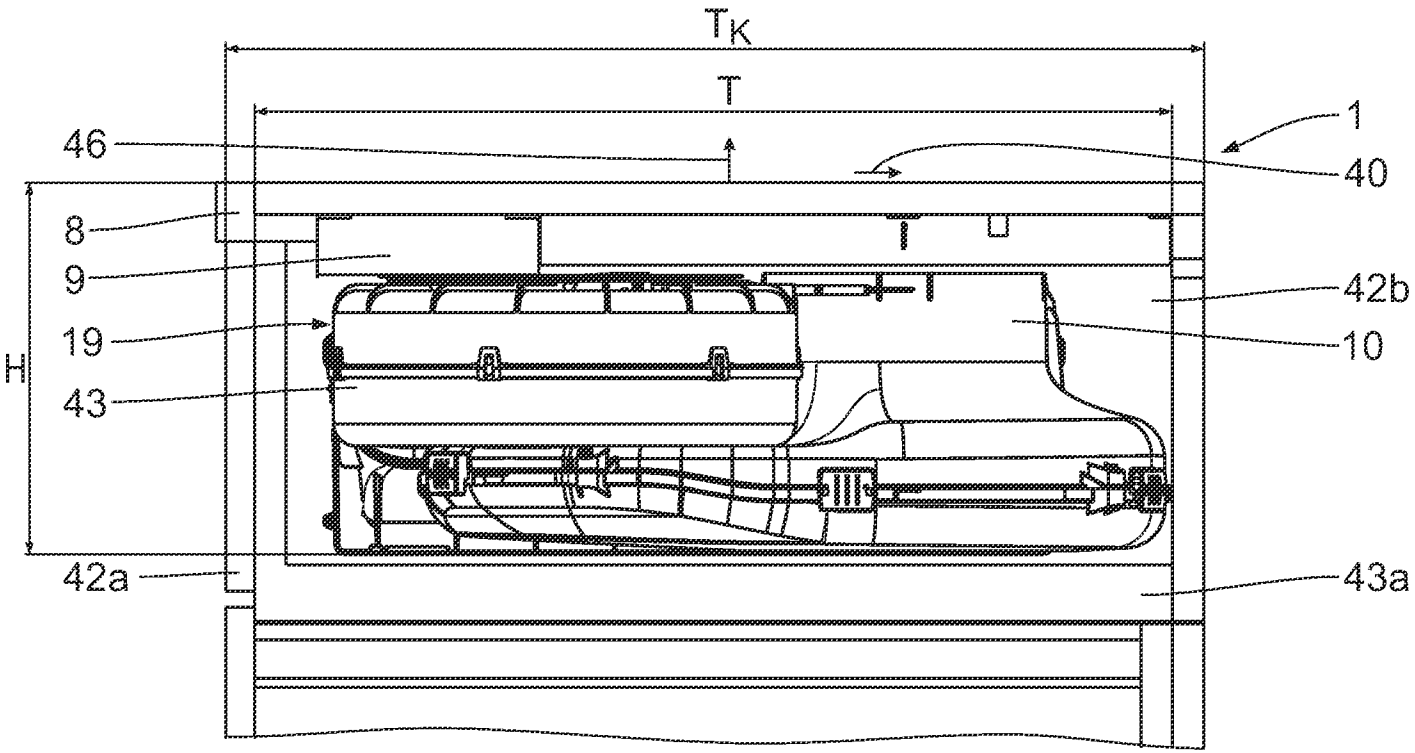
FIG. 12 shows a side view of the hob system in FIG. 11.

With reference to FIG. 11 and FIG. 12, a further embodiment of the invention is described. In contrast to the previous embodiments, the hob system 1 has a cooking goods carrier 4, three heating units 5 and one fume extractor device 3 with exactly one fan 19. The fan 19 of the fume extractor device 3 is designed as a radial fan. The fan 19 is in fluid-conducting communication with the inflow opening 18 via the inflow duct 10.

A total width B of the hob system 1 is 560 mm. A total installation height H of the hob system 1 including the fan 19 is 180 mm. The depth T of the hob system 1 is 515 mm.

The fume extractor device 3 comprises the fan 19, wherein the hob system 1 is designed as a combined appliance for one-piece installation in the workplace 8.

The inflow opening 18 of the fan 19 penetrates the cooking goods carrier 4. The inflow opening 18 is circular in a top view. The fume extractor device 3 has an inflow grille 28 which can be arranged reversibly at the inflow opening 18. In a top view, the inflow grille 28 completely covers the inflow opening 18. The inflow grille 28 comprises lamellar guiding elements 34 arranged concentrically to one another to support a laminar extraction of the cooking vapors through the inflow grille 28 and the inflow opening 18.

A geometric center of area 37 of the inflow opening 18 is arranged at a distance from a geometric center of area 38 of the cooking goods carrier 4. A distance $a_E$ between the geometric center of area 37 of the inflow opening 18 and the geometric center of area 38 of the cooking goods carrier 4 is 100 mm. The geometric center of area 37 of the inflow opening 18, in the top view, is arranged at a distance from the geometric center of area 38 of the cooking goods carrier 4, along a width direction 39 as well as along a depth direction 40.

A smallest distance $a_{H1}$ between the geometric center of area 38 of the cooking goods carrier 4 and a first one of the heating units 5 is 75 mm and a smallest distance $a_{H2}$ between the geometric center of area 38 of the cooking goods carrier 4 and a second one of the heating units 5 is 10 mm. A smallest distance $a_{EH1}$ between the inflow opening 18 and the first heating unit 5 is equal to a smallest distance $a_{EH2}$ between the inflow opening 18 and the second heating unit 5 and equal to a smallest distance $a_{EH3}$ between the inflow opening 18 and the third heating unit 5. The smallest distance $a_{EH1}$, $a_{EH2}$, $a_{EH3}$ between the inflow opening and the heating units 5 is 40 mm.

The hob system 1 has the user interface 9. The user interface 9 comprises a touch-sensitive surface 41 and a plurality of display elements 42. The user interface 9 is configured for controlling the heating units 5 and the fume extractor device 3. The user interface 9, in a top view, is arranged relative to one of the heating units 5 opposite to the inflow opening 18. In particular, an outer edge of the user interface 9 is arranged along the width direction 39 and along the depth direction 40 spaced apart from the geometric center of area 38 of the cooking goods carrier 4. The user interface 9 is arranged in a lateral edge region of the cooking goods carrier 4.

In FIG. 12, the hob system 1 is shown in a side view. The fan 19 comprises a fan housing 43. The fan housing 43 is arranged above a lowest point of the inflow duct 10. A distance between the lowest point of the inflow duct 10 and the fan housing 43 is 50 mm. The fan housing 43 is arranged completely below the heating elements 5. A particularly compact design of the hob system 1 in the horizontal direction is thus ensured.

The hob system 1 is at least partially received in a kitchen base cabinet 42*a*. The hob system 1 penetrates the workplace 8, which is supported on the kitchen base cabinet 42*a*. A cabinet width $B_K$ of the kitchen base cabinet 42*a* is 600 mm. A cabinet depth $T_K$ of the kitchen base cabinet 42*a* is also 600 mm. The kitchen base cabinet 42*a* has a storage space 42*b* for receiving the hob system 1 and drawers or shelves. A storage space width $B_S$ of the kitchen base cabinet 42*a* is 580 mm.

The kitchen base cabinet 42*a* includes insulation 43*a*. The insulation 43*a* is arranged on the kitchen base cabinet 42*a* such that it surrounds a bottom side and a front side of the hob system 1. The insulation 43*a* ensures a reduced noise emission and a reduced heat input into a lower portion of the kitchen base cabinet 42*a*.

The mode of operation of the hob system 1 according to this embodiment corresponds to the mode of operation of the hob systems 1 described above.

Figure 13:
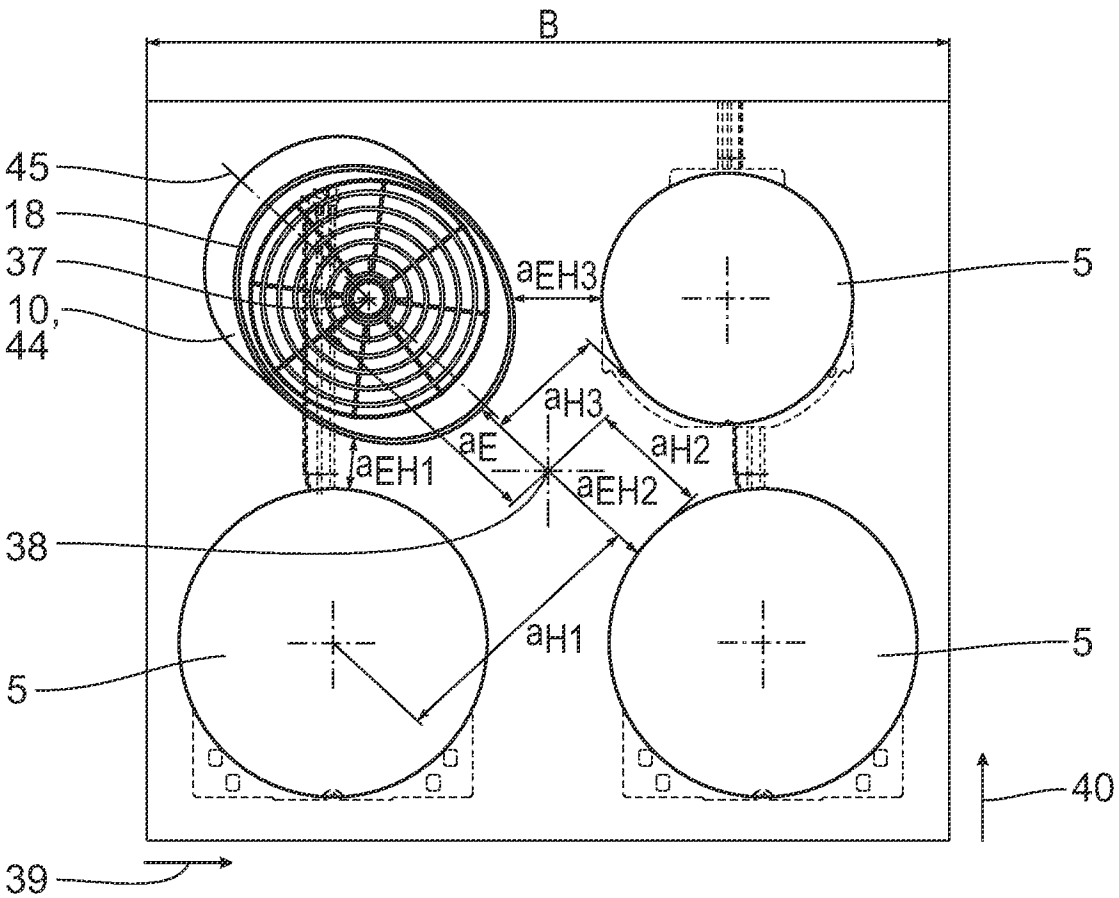
FIG. 13 shows a top view onto a hob system according to a further embodiment, wherein a central longitudinal axis of an inflow duct is formed in an inclined manner to a hob normal.

FIG. 13 shows another embodiment of a hob system 1. In contrast to the hob systems 1 described above, an initial portion 44 of the inflow duct 10 has a central longitudinal axis 45 which is oriented obliquely to a hob normal 46. An angle between the central longitudinal axis 45 of the initial portion 44 and the hob normal 46 is 45°.

The initial portion 44 is circular in cross-section. The inflow opening 18 is elliptical in shape due to the oblique orientation of the central longitudinal axis 45 to the hob normal 46.

Due to the fact that the total width B of the hob system is a maximum of 600 mm, in particular 560 mm, it is possible for the first time to arrange the hob system 1 with the fume extractor device 3 in a kitchen base cabinet 42*a* with especially small dimensions. Advantageously, as a result, such hob systems 1 can be used in a particularly flexible manner and can thus be installed to a considerably greater extent. A design of the hob system 1 with an installation height of a maximum of 200 mm is particularly advantageous, since the storage space 42*b* is thereby maintained to the greatest possible extent for accommodating, for example, kitchen utensils.

Figure 14:
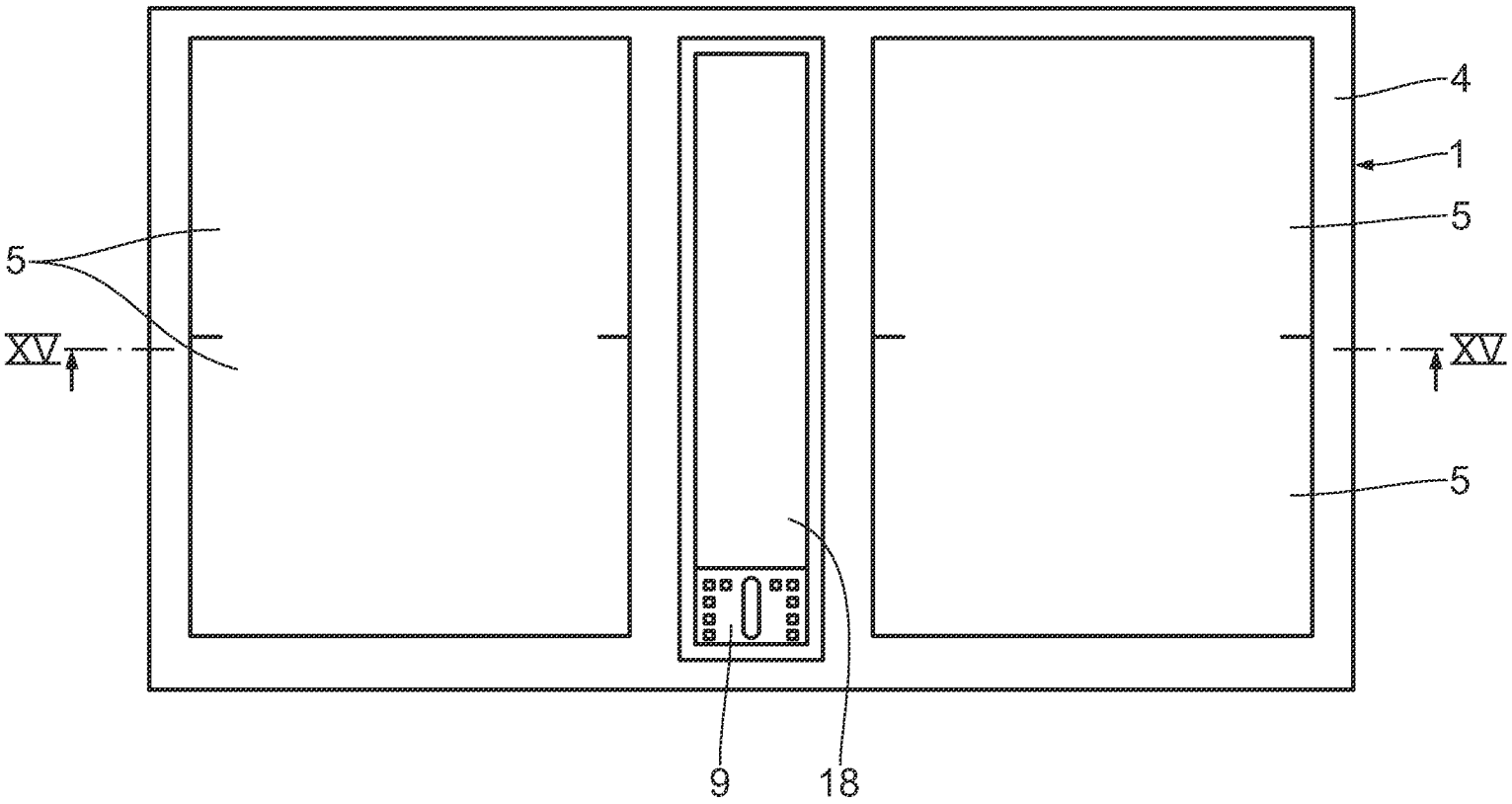
FIG. 14 shows a top view onto a hob system with four heating units and a fume extractor device.
Figure 15:
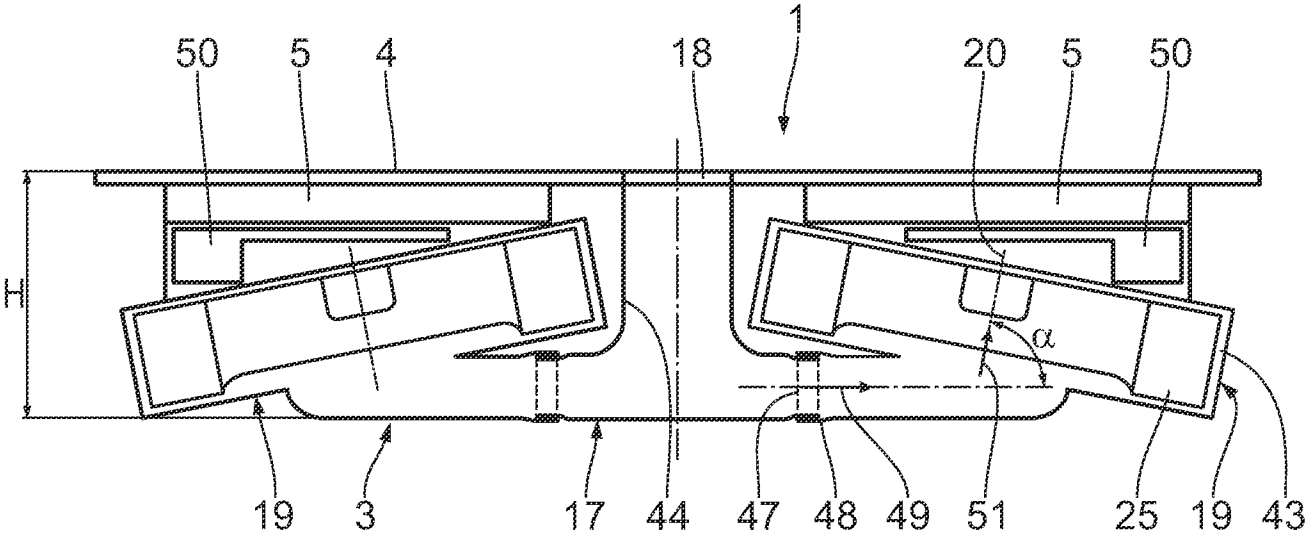
FIG. 15 shows a sectional view of the hob system along the section line XV-XV in FIG. 14 with two fans, each having a fan wheel rotatably mounted about an axis of rotation, wherein the axis of rotation is oriented in an inclined manner to a horizontal plane and to a vertical direction.

FIG. 14 and FIG. 15 show a further embodiment of the hob system 1. In contrast to the hob systems 1 described above, the fume extractor device 3 comprises two fans 19, each with fan wheels 25 rotatably mounted about an axis of rotation 20, wherein the axes of rotation 20 each are oriented in an inclined manner to a horizontal plane and to a vertical direction. The hob system 1 comprises four heating units 5 which are rectangular in a top view. The heating units 5 and the fume extractor device 3 are in signal communication with a user interface 9.

The fume extractor device 3 has an inflow opening 18 arranged centrally at a cooking goods carrier 4. An initial portion 44 of a negative pressure duct 17 is connected to the inflow opening 18.

The fans 19 each have a fan housing 43. The fan housing 43 comprises a negative pressure connection opening 47. The initial portion 44 penetrates the negative pressure connection opening 47. A duct connection 48 connects the initial portion 4 to the fan housing 43 in a fluid-tight manner.

A connection normal 49 is oriented perpendicularly to the negative pressure connection opening 47. The connection normal 49 encloses a connection angle $\alpha$ of 80° with the axis of rotation 20.

Power electronics 50 for supplying the heating units 5 are mounted below the respective heating unit 5. Due to the inclination of the axis of rotation 20, space required for the power electronics 15, in particular for individual components of the power electronics 15 which require a lot of installation space, is provided in a region between the respective heating unit 5 and the fan 19.

The two fans 19 overlap the heating units 5 in both a top view and a side view. As a result, the hob system 1 is configured in a particularly compact manner. An total installation height H is 180 mm.

A suction direction 51 of the fan 19 has a directional component facing vertically upward. The suction direction 51 is oriented in parallel to the axis of rotation 20. Due to the fact that the suction direction 51 has the upwardly facing directional component, the fan 19 is reliably protected from penetrating liquids.

The invention claimed is:

1. A hob system, comprising a cooking goods carrier for carrying cooking goods, at least one heating unit arranged at the cooking goods carrier for heating the cooking goods, the at least one heating unit having at least one heating element and power electronics for supplying the heating element with electrical power, and a fume extractor device for extracting cooking vapors downward, with at least one fan for extracting the cooking vapors, wherein a total width of the hob system is a maximum of 600 mm, and wherein the at least one fan overlaps at least one of the at least one heating unit and the power electronics in a top view and in at least one of a side view and a front view.

2. The hob system as claimed in claim 1, wherein a vertical installation height of the hob system is a maximum of 200 mm.

3. The hob system as claimed in claim 1, wherein the hob system is designed as a combined appliance.

4. The hob system as claimed in claim 1, comprising exactly three of the heating units.

5. The hob system as claimed in claim 1, wherein the maximum power output of the at least one heating unit is in a range of 300 to 4000 watts.

6. The hob system as claimed in claim 1, wherein the fume extractor device has an inflow duct which is connected to the at least one inflow opening and whose central longitudinal axis is designed to be inclined with respect to a hob normal in an initial portion adjoining the inflow opening.

7. The hob system as claimed in claim 1, wherein a geometric center of area of the at least one inflow opening, in a top view, is arranged at a distance from a geometric center of area of the cooking goods carrier.

8. The hob system as claimed in claim 7, wherein the at least one inflow opening, in the top view, is arranged at a distance from a geometric center of area of the cooking goods carrier in the at least one of the width direction and in the depth direction.

9. The hob system as claimed in claim 1, comprising a plurality of the heating units, wherein, in a top view, a smallest distance between a geometric center of area of the cooking goods carrier and a first one of the heating units is at least twice as large as a smallest distance between the geometric center of area of the cooking goods carrier and a second one of the heating units.

10. The hob system as claimed in claim 1, comprising a plurality of the heating units, wherein, in a top view, all smallest distances between the at least one inflow opening and the respective heating unit differ by a maximum of 30%.

11. The hob system as claimed in claim 1, wherein a smallest distance between the at least one inflow opening and the at least one heating unit in a top view is a maximum of 100 mm.

12. The hob system as claimed in claim 1, wherein the at least one heating unit overlaps a geometric center of area of the cooking goods carrier in a top view.

13. The hob system as claimed in claim 1, comprising a user interface for controlling at least one of the at least one heating unit and the fume extractor device, wherein the user interface, in a top view relative to at least one of the heating units, is arranged opposite to the at least one inflow opening.

14. A kitchen workplace, comprising a kitchen base cabinet with a storage space, which has a storage space width of a maximum of 600 mm, and a hob system as claimed in claim 1, wherein the heating units and the fume extractor device, in a top view, are arranged completely within the storage space.

* * * * *